US012740612B2

(12) United States Patent
Watts et al.

(10) Patent No.: US 12,740,612 B2
(45) Date of Patent: Sep. 22, 2026

(54) ARTICLE OF FOOTWEAR FOR SKATING ON ICE

(71) Applicant: Warrior Sports, Inc., Shelby Township, MI (US)

(72) Inventors: Neal Watts, Montreal (CA); John Dekemp, Montreal (CA); Adam Gans, Prevost (CA)

(73) Assignee: Warrior Sports, Inc., Shelby Township, MI (US)

( * ) Notice: Subject to any disclaimer, the term of this patent is extended or adjusted under 35 U.S.C. 154(b) by 0 days.

(21) Appl. No.: 18/790,405

(22) Filed: Jul. 31, 2024

(65) Prior Publication Data

US 2025/0143405 A1 May 8, 2025

Related U.S. Application Data

(60) Provisional application No. 63/516,731, filed on Jul. 31, 2023.

(51) Int. Cl.
*A43B 5/16* (2006.01)
*A43B 23/08* (2006.01)
(Continued)

(52) U.S. Cl.
CPC ..... *A43B 5/1683* (2013.01); *A43B 23/088* (2013.01); *A43B 23/17* (2013.01); *A43B 23/28* (2013.01)

(58) Field of Classification Search
CPC ..... A43B 23/16; A43B 7/20; A43B 5/1625; A43B 5/16
See application file for complete search history.

(56) References Cited

U.S. PATENT DOCUMENTS 1,130,859 A 3/1915 Thomas
2,789,374 A * 4/1957 Planert ..... A63B 71/1225 36/89

(Continued)

FOREIGN PATENT DOCUMENTS

CA 2302953 A1 3/1999
EP 3563713 A1 11/2019

OTHER PUBLICATIONS

International Search Report and the Written Opinion for International Application No. PCT/US2024/017119 dated Jun. 13, 2024, pp. 1-21.

(Continued)

*Primary Examiner* — Jillian K Pierorazio
(74) *Attorney, Agent, or Firm* — Goodwin Procter LLP

(57) ABSTRACT

An article of footwear for use in ice skating comprising a boot shell structured to accommodate a wearer's foot and having a medial forefoot portion, a lateral forefoot portion, a medial quarter/midfoot portion, a lateral quarter/midfoot portion, a sole portion, a lateral ankle portion, a medial ankle portion, and a heel portion, the boot shell further including a cuff/tendon guard attached to the boot shell or to a flexible rail portion attached to the heel portion of the boot shell. An article of footwear for use in ice skating including a removable liner disposed in a boot shell and a plate reinforcement portion attached to the removable liner to provide lateral stiffness. An article of footwear for use in ice skating including at least one compressible structure disposed in a boot shell.

18 Claims, 21 Drawing Sheets

(51) Int. Cl.
*A43B 23/17* (2006.01)
*A43B 23/28* (2006.01)

(56) References Cited

U.S. PATENT DOCUMENTS 3,235,978 A * 2/1966 Hyde ..... A43B 23/08 280/11.36
4,107,856 A * 8/1978 Bourque ..... A43B 5/1666 36/118.2
4,509,276 A * 4/1985 Bourque ..... A43B 5/1683 12/142 R
5,926,979 A 7/1999 Borel
6,079,128 A * 6/2000 Hoshizaki ..... A43B 23/16 36/89
6,871,424 B2 3/2005 Labonte et al.
8,266,827 B2 9/2012 Dojan et al.
9,055,785 B2 6/2015 Dojan et al.
9,420,850 B2 8/2016 Dojan et al.
10,376,771 B2 * 8/2019 Rouzier ..... A63C 1/303
10,383,396 B1 8/2019 Malinowski et al.
11,147,340 B2 10/2021 Bartel et al.
11,197,517 B2 12/2021 Manz et al.
2004/0016150 A1 * 1/2004 Labonte ..... A43B 5/1666 36/115
2004/0074589 A1 4/2004 Gessler et al.
2005/0116379 A1 * 6/2005 Goldsmith ..... B29C 70/345 264/222
2005/0193594 A1 * 9/2005 Murphy ..... A43B 23/088 36/89
2005/0210709 A1 * 9/2005 Labonte ..... B29D 35/146 36/89
2008/0172906 A1 * 7/2008 Jou ..... A43B 23/081 12/147 R
2009/0243238 A1 10/2009 Van Horne et al.
2010/0139126 A1 * 6/2010 Koyess ..... A43B 5/1625 280/841
2010/0156058 A1 * 6/2010 Koyess ..... A43B 5/16 12/142 P
2010/0192412 A1 * 8/2010 Stewart ..... A43B 7/20 36/89
2011/0101665 A1 * 5/2011 Van Horne ..... A43B 5/1691 280/841
2012/0025478 A1 * 2/2012 Van Horne ..... A63C 1/22 280/11.12
2012/0204452 A1 * 8/2012 Van Horne ..... A43B 5/1691 36/115
2013/0214499 A1 * 8/2013 Koyess ..... A43B 5/1625 12/142 P
2013/0291318 A1 * 11/2013 Stewart ..... A43B 7/20 12/146 B
2013/0298339 A1 * 11/2013 Koyess ..... A63C 1/42 12/146 C
2014/0013628 A1 * 1/2014 Van Horne ..... A43B 23/26 36/115
2014/0202040 A1 * 7/2014 Van Horne ..... A43B 5/1691 36/116
2014/0230165 A1 * 8/2014 Stewart ..... A43B 7/18 12/142 P
2014/0250733 A1 9/2014 Cruikshank et al.
2014/0252736 A1 9/2014 Lefebvre et al.
2014/0259780 A1 * 9/2014 Labonte ..... A43B 5/0405 36/102
2014/0259794 A1 * 9/2014 Labonte ..... A43B 23/087 36/115
2014/0327216 A1 * 11/2014 Koyess ..... A43B 5/1641 12/142 P
2015/0089844 A1 * 4/2015 Champagne ..... A43B 7/20 36/115
2015/0327623 A1 * 11/2015 Koyess ..... A43B 5/16 36/115
2018/0043233 A1 * 2/2018 Harvey ..... A63C 3/00
2019/0098958 A1 4/2019 Bee et al.
2019/0261730 A1 8/2019 Koyess et al.
2020/0008514 A1 1/2020 Dua et al.
2020/0367602 A1 11/2020 Amis et al.
2021/0206130 A1 * 7/2021 Labonte ..... A43D 3/027
2021/0337918 A1 * 11/2021 Champagne ..... A43B 5/1691
2021/0401109 A1 * 12/2021 Labonte ..... A63C 1/42
2022/0248807 A1 8/2022 Drake et al.

OTHER PUBLICATIONS

International Search Report and the Written Opinion for International Application No. PCT/US2024/040331 dated Jan. 9, 2025, pp. 1-26.

U.S. Appl. No. 18/586,096, Composite Skate Shell and Method of Manufacturing Thereof, filed Feb. 23, 2024.

* cited by examiner

ARTICLE OF FOOTWEAR FOR SKATING ON ICE

CROSS-REFERENCE TO RELATED APPLICATION

This application claims priority to and the benefit of U.S. Provisional Patent Application No. 63/516,731, entitled "ARTICLE OF FOOTWEAR FOR SKATING ON ICE," filed on Jul. 31, 2023, the entire contents of which are incorporated herein by reference.

FIELD OF THE INVENTION

Embodiments of this invention relate to an article of footwear for use in an athletic activity and, more specifically, to embodiments of an article of footwear for skating on ice.

BACKGROUND

The game of ice hockey has undergone a massive evolution in the past 20 years, becoming much faster and higher-skilled. More particularly, quick movement and agility have become critical skating skills for the modern ice hockey player. At the same time, equipment (e.g., skates) has substantially decreased in weight, allowing players to skate faster and with less effort.

Early ice hockey skates—typically manufactured from leather and/or nylon fabrics and resembling traditional work boots—were heavy, soft, and broke down quickly. Problematically, the skate boots did not provide adequate support to the foot and ankle regions of the skater or enough protection to those and other foot areas against increasingly harder shots.

This changed in the late 1990s as skates manufactured from fiber reinforced composite materials (e.g., polypropylene fibers with a polypropylene matrix) were introduced. These stiffer boots offered more support and greater protection. Disadvantageously, stiffer boots came at the expense of boot flexibility and the associated range of motion. Furthermore, manufacturers conventionally employed orthotropic materials, which offer equal stiffness in every direction. The advantage to orthotropic materials is that a variety of shapes can be die cut from a single piece of material without any limitation to die orientation. Thus, nesting efficiency is higher and cutting loss is reduced during the manufacturing process. One disadvantage to these materials, however, is that lateral stiffness is directly coupled to the stiffness in the longitudinal axis. Thus, increasing lateral stiffness (e.g., to provide ankle support) tends to increase the longitudinal stiffness and the associated resistance to forward flex. In summary, stiffer composite boots restrict the movement of the skater's leg, requiring more work and preventing an efficient stride.

Due to the limitations on ankle range of motion imparted by the stiff, orthotropic materials, skaters have adapted various self-help techniques to facilitate the flexion they need to comfortably perform skating tasks. Since skate laces and the shoe tongue provide a majority of the support in dorsiflexion, they are also the primary areas where skaters adjust personal forward-leaning support and mobility. For example, a common tactic may include omitting laces in the top one or two pairs of eyelets of the skate. This tactic leaves more room for the skate tongue to move anteriorly (i.e., in the direction of skating) as skaters move through dorsiflexion, as well as lowering the fulcrum point between the skater's lower shin and the uppermost tensioned lace. Problematically, excluding the upper one or two laces mandates a loss of lateral support to the skater's ankle, with the stiffness of the boot being dependent on lace tightness.

Another trend for recreational athletes is the use of lower-end skate boots, made with orthotropic materials with less stiffness than upper-end models. Inherently, these boots also come with less lateral stiffness and support due to the orthotropy of materials used. Furthermore, such skates provide skaters with the desired range of motion at the cost of a weight increase and, often, a loss of product features.

Accordingly, conventional skate boots, accommodations made by skaters for greater performance, and correlated injury patterns demonstrate that there is a clear incompatibility between the standard human foot and current hockey skate products. The two main mechanisms are relative motion, and thus friction, between the foot and skate, and exaggerated pressure points between the two. Indeed, friction indicates a loss of energy, and, more particularly, the lever action of the foot within the skate indicates that force application to the ice is being reduced at a certain point, where expended energy is beginning to fight the boot and allow the foot to move independent of the boot. This is to say nothing of the compromise in terms of force application that is inherent to the change of the foot position relative to the skate, and loss of contact area resulting from heel lift.

A desirable skate is one that efficiently delivers energy expended by the user (e.g., wearer) to the ice to generate the desired skating motion. Modern skating mechanics require that the skater's weight can be centered over the blade and a change of pressure transferred easily. This requires, however, that the skater's foot and lower leg be easily positioned 45 degrees from one to the other. Therefore, a more flexible upper section is required to allow the player to flex forward more easily. Thus, more force can be applied and controlled during the skating stride.

Hockey skates typically include a boot to accommodate a user's foot, a skate blade that contacts the ice and supports the user, and a skate blade holder that fixedly and rigidly holds the skate blade and connects the skate blade to the boot. Conventional methods of manufacturing the boot for a pair of hockey skates include a last design method and a monocoque design method. The former follows traditional manufacturing techniques for articles of footwear, which is to say that, for the boot portion, flat materials of various compositions are wrapped around a footlike form to produce a shoe-like structure to which an outsole may be attached. The outsole may then be fixedly and rigidly attached to the holder and blade.

The latter manufacturing techniques include forming a shell for accommodating the user's foot and attaching (e.g., bolting or riveting) the skate blade holder and blade to the boot. For example, referring to FIGS. 1A and 1B, a conventional, monocoque hockey skate 10 includes a boot or shell portion ("boot shell") 11, a skate blade holder 12, and a blade 13.

As shown in FIGS. 1A-1D, the boot or shell portion 11 can include a medial forefoot portion, a lateral forefoot portion, a medial quarter/midfoot portion, a lateral quarter/midfoot portion, a sole portion, a lateral ankle portion, a medial ankle portion, and a heel portion. The medial and lateral forefoot portions may be respectively proximate medial and lateral forefoot regions of a foot of a user, with the forefoot region of the foot including the metatarsals and phalanges of the foot. The medial and lateral quarter/midfoot portions may be respectively proximate medial and lateral midfoot regions of a foot of a user, with the midfoot region of the foot including the cuboid, navicular, and cuneiform bones of the foot. The sole portion may be proximate a sole of a foot of a user. The medial and lateral ankle portions may be respectively proximate medial and lateral ankle portions of a foot of a user. The heel portion may include a lower heel portion, an upper heel portion, and an Achilles heel portion. In some variations, the Achilles heel portion may include a back ankle portion. The heel portion may be proximate a heel of a foot of a user, with the heel of the foot including a calcaneus bone of the foot.

In some embodiments, the (e.g., nylon, injection-molded) skate blade holder 12 may be structured and arranged to include a quick release mechanism that includes a trigger mechanism for releasably attaching the (e.g., stainless steel) blade 13 to the skate blade holder 12. Typically, the skate blade holder 12 may be riveted (e.g., using metal rivets) to the boot or shell portion 11 proximate the toe and heel portions of the boot or shell portion 11. Additional features of the hockey skate 10 may include a (e.g., injection molded, nylon) toe cap 14, a (e.g., felt or polyurethane) tongue portion 15, an (e.g., injection molded, nylon) Achilles heel tendon guard 16, and two (e.g., polyurethane) reinforcement portions 17 that are adapted to cover a periphery, e.g., edges, of the boot or shell portion 11. A number of (e.g., metal) eyelets 18 for receiving lacings 19 may be provided in each reinforcement portion 17 along a periphery of the boot or shell portion 11, with the eyelets 18 on opposing reinforcement portions 17 forming pairs of eyelets 18. As an example, the eyelets 18 may be provided along (e.g., opposing) edges of medial and lateral forefoot, quarter/midfoot, and/or ankle portions of the boot or shell portion 11. Each reinforcement portion 17 may include between five eyelets 18 and thirteen eyelets 18. As an example, the boot or shell portion 11 can include nine eyelets 18.

FIGS. 1C and 1D show two views of a (e.g., rigid, thermoplastic composite) monocoque boot or shell portion 11. Typically, the (e.g., rigid, thermoplastic composite) monocoque boot or shell portion 11 is structured and arranged to include a quarter/midfoot portion 11*a* and a heel portion 11*b*. The quarter/midfoot portion 11*a* may be manufactured from a substantially rigid composite material that is thermoformable at 180 degrees Fahrenheit (° F.), while the heel portion 11*b* may be manufactured from a rigid composite material that is not thermoformable at 180° F. A thermoformable foam/fabric liner may be glued onto the inner surface of the shell portion 11.

The desired thermoformability characteristics for a conventional skate boot design and the desired flexibility/stiffness characteristics for a conventional skate boot design are shown, respectively, in FIGS. 1A and 1B and FIGS. 1C and 1D. Preferably, as shown in FIGS. 1A and 1B, area 21 corresponds to a portion of the boot or shell portion 11 in which a high degree of thermoformability is desirable; area 22 corresponds to a portion of the boot or shell portion 11 in which a medium degree of thermoformability is desirable; and area 23 corresponds to a portion of the boot or shell portion 11 in which a low or zero degree of thermoformability is desirable. Moreover, as shown in FIGS. 1C and 1D, less stiffness 24 built into the boot or shell portion 11 is preferred running in an essentially longitudinal direction along the length of the foot in the midfoot and instep regions of the boot or shell portion 11, while more stiffness 25 built into the boot or shell portion 11 is preferred running in an essentially horizontal direction in the heel regions of the boot or shell portion 11 and in an essentially vertical direction in the toe and midfoot regions of the boot or shell portion 11.

Each of these manufacturing techniques employs a compression molding process that uses composites such as a (e.g., rigid) thermoset, a thermoplastic, and the like. Disadvantageously, these materials typically are very rigid at room temperatures; consequently, the composites are typically heated during the lay-up process, which requires expensive equipment for heating and laying the materials.

SUMMARY

Accordingly, it is desirable to provide an article of footwear for ice skating that overcomes the shortcomings of the prior art. Although embodiments of the invention are described herein for the particular use of playing ice hockey, those of ordinary skill in the art can appreciate the applicability of the technologies described herein to other uses associated with skating on ice.

In one aspect, embodiments of the invention relate to articles of footwear for use in ice skating. In some embodiments, the article of footwear includes a boot shell structured and arranged to accommodate a wearer's foot and having a medial forefoot portion, a lateral forefoot portion, a medial quarter/midfoot portion, a lateral quarter/midfoot portion, a sole portion, a lateral ankle portion, a medial ankle portion, and a heel portion and a cuff/tendon guard including a cuff mounting portion attached to the flexible rail portion. Advantageously, the boot shell further includes at least one flexible rail portion integrated into the heel portion of the boot shell.

In some implementations, the flexible rail portion includes a flange cantilevered from the heel portion of the boot shell, such that the flexible rail portion extends to at least one of: to, below, or above a height of the lateral and medial ankle portions of the boot shell. In some applications, the flexible rail portion is separated from the lateral and medial ankle portions of the boot shell by a pair of (e.g., symmetric or asymmetric) gaps. In some variations, each gap has a width selected from a range of between about 5 mm and 50 mm. In some embodiments, the flexible rail portion is structured and arranged to be elastically deformable along a longitudinal axis of the article of footwear. In some embodiments, the flexible rail portion is structured and arranged to (i) provide progressive flexure and energy storage during a loading phase of a skating stride, wherein the loading phase of the skating stride includes dorsiflexion of the wearer's foot to a dorsiflexed position and (ii) provide an energy return that is based on the energy storage during an unloading phase of the skating stride, wherein the unloading phase of the skating stride includes recovery of the wearer's foot to a neutral position from the dorsiflexed position.

In some implementations, the flexible rail portion may be integrated into the heel portion of the boot shell; may have at least one of a uniform thickness or a variable thickness; may have at least one of a uniform width or a variable width; and/or may have a width selected from a range of between about 5 mm and 70 mm.

In some implementations, the cuff/tendon guard may be a thermoplastic composite material; may be at least one of fixedly attached to the flexible rail portion or removably attached to the flexible rail portion; may include a sleeve portion that is configured to accommodate the flexible rail portion; may be posteriorly biased in a neutral state; may be configured to follow contouring of the boot shell; and/or may be at least one of removable or interchangeable to provide a desired stiffness level.

Advantageously, the boot shell may include layers of non-orthotropic fibers and, more particularly, the non-orthotropic layers may be asymmetric and/or unbalanced. In some variations, the article of footwear may also include a tongue component attached to the boot shell. Optionally, the tongue component may be removable and/or interchangeable.

In another aspect, the article of footwear may include a boot shell structured and arranged to accommodate a wearer's foot and having a medial forefoot portion, a lateral forefoot portion, a medial quarter/midfoot portion, a lateral quarter/midfoot portion, a sole portion, a lateral ankle portion, a medial ankle portion, and a heel portion; and a cuff/tendon guard (e.g., fixedly) attached to the boot shell.

In some implementations, the heel portion of the boot shell may include a lower heel portion. Advantageously, the boot shell may define an open back portion disposed above the lower heel portion of the boot shell. In some variations, the cuff/tendon guard may be attached to one or more points around a periphery of the open back portion of the boot shell and/or may be attached to the lower heel portion of the boot shell.

In some variations, the article of footwear may include a blade holder attached to a sole portion of the boot shell via one or more fasteners. In some variations, the cuff/tendon guard is attached to the boot shell via the one or more of the fasteners attaching the blade holder to the sole portion of the boot shell.

In some implementations, the cuff/tendon guard may include at least one flexible rail portion. In some variations, the flexible rail portion may extend to at least one of: to, below, or above a height of the lateral and medial ankle portions of the boot shell. In some variations, the flexible rail portion may extend to at least one of: to, below, or above a height of the lower heel portion of the boot shell. The flexible rail portion may be structured and arranged to be elastically deformable along a longitudinal axis of the article of footwear. In some variations, the flexible rail portion may be at least one of fixedly attached to the cuff/tendon guard or removably attached to the cuff/tendon guard. In some variations, the flexible rail portion may be integrated into the cuff/tendon guard. In some variations, the flexible rail portion may be positioned proximate a heel portion of the cuff/tendon guard. In some variations, the flexible rail portion may be structured and arranged to: provide progressive flexure and energy storage during a loading phase of a skating stride, wherein the loading phase of the skating stride includes dorsiflexion of the wearer's foot to a dorsiflexed position; and provide an energy return that is based on the energy storage during an unloading phase of the skating stride, wherein the unloading phase of the skating stride includes recovery of the wearer's foot to a neutral position from the dorsiflexed position.

In some implementations, the cuff/tendon guard may be fixedly attached to the boot shell. In some implementations, the cuff/tendon guard can include (i) a cuff portion manufactured from an elastomer material and (ii) a tendon guard portion manufactured from a thermoplastic composite material.

In some implementations, at least one of the lateral ankle portion or the medial ankle portion the cuff/tendon guard further includes a tensile structure manufactured from an elastomer material. In some variations, the tensile structure may be structured and arranged to be elastically deformable along a longitudinal axis of the article of footwear. In some variations, the tensile structure may be structured and arranged to: provide progressive flexure and energy storage during a loading phase of a skating stride, wherein the loading phase of the skating stride includes dorsiflexion of the wearer's foot to a dorsiflexed position; and provide an energy return that is based on the energy storage during an unloading phase of the skating stride, wherein the unloading phase of the skating stride includes recovery of the wearer's foot to a neutral position from the dorsiflexed position.

In some implementations, the article of footwear may include a compressible structure manufactured from a foam or elastomer material disposed between the heel portion of the boot shell and the cuff/tendon guard. In some variations, the compressible structure may be structured and arranged to be elastically deformable along a longitudinal axis of the article of footwear. In some variations, the compressible structure may be structured and arranged to: provide progressive flexure and energy storage during a loading phase of a skating stride, wherein the loading phase of the skating stride includes dorsiflexion of the wearer's foot to a dorsiflexed position; and provide an energy return that is based on the energy storage during an unloading phase of the skating stride, wherein the unloading phase of the skating stride includes recovery of the wearer's foot to a neutral position from the dorsiflexed position.

In some implementations, the cuff/tendon guard can be attached to one or more points around a periphery (e.g., edge) of the boot shell. In some variations, the cuff/tendon guard can be attached to at least one of the lateral ankle portion, the medial ankle portion, or the heel portion of the boot shell. In some variations, the heel portion of the boot shell can include a lower heel portion, an upper heel portion, and an Achilles heel portion. In some implementations, the article of footwear may include one or more engagement structures extending from the heel portion of the boot shell, the one or more engagement structures being configured to engage with the cuff/tendon guard. In some implementations, the article of footwear may include a number of eyelets defined by (i) the lateral and medial ankle portions of the boot shell and (ii) the cuff/tendon guard, wherein the cuff/tendon guard may be attached to the boot shell by one or more of the number of eyelets.

In another aspect, the article of footwear may include a boot shell structured and arranged to accommodate a wearer's foot and having a medial forefoot portion, a lateral forefoot portion, a medial quarter/midfoot portion, a lateral quarter/midfoot portion, a sole portion, a lateral ankle portion, a medial ankle portion, and a heel portion; a removable liner disposed in the boot shell; and a plate reinforcement portion attached to the removable liner to provide lateral stiffness. In some variations, the removable liner may be manufactured from a thermoformable foam material and the plate reinforcement portion may be manufactured from a thermoplastic composite material.

In another aspect, the article of footwear may include a boot shell structured and arranged to accommodate a wearer's foot and having a medial forefoot portion, a lateral forefoot portion, a medial quarter/midfoot portion, a lateral quarter/midfoot portion, a sole portion, a lateral ankle portion, a medial ankle portion, and a heel portion. Advantageously, the article of footwear includes at least one compressible structure disposed in the boot shell.

In some implementations, the compressible structure may be disposed in at least one of the lateral ankle portion, the medial ankle portion, the lateral quarter/midfoot portion, or the medial quarter/midfoot portion of the boot shell. In some variations, the compressible structure may be manufactured from a foam, elastomer, or thermoplastic composite material. In some variations, the compressible structure may include an accordion structure including two or more corrugations. In some variations, the compressible structure may be structured and arranged to: provide progressive flexure and energy storage during a loading phase of a skating stride, wherein the loading phase of the skating stride includes dorsiflexion of the wearer's foot to a dorsiflexed position; and provide an energy return that is based on the energy storage during an unloading phase of the skating stride, wherein the unloading phase of the skating stride includes recovery of the wearer's foot to a neutral position from the dorsiflexed position.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of embodiments of the invention. In the following description, various embodiments of the present invention are described with reference to the following drawings, in which.

DETAILED DESCRIPTION

Boot or Shell Portion with Flexible Rail Portion and Cuff/Tendon Guard

Figure 2B:
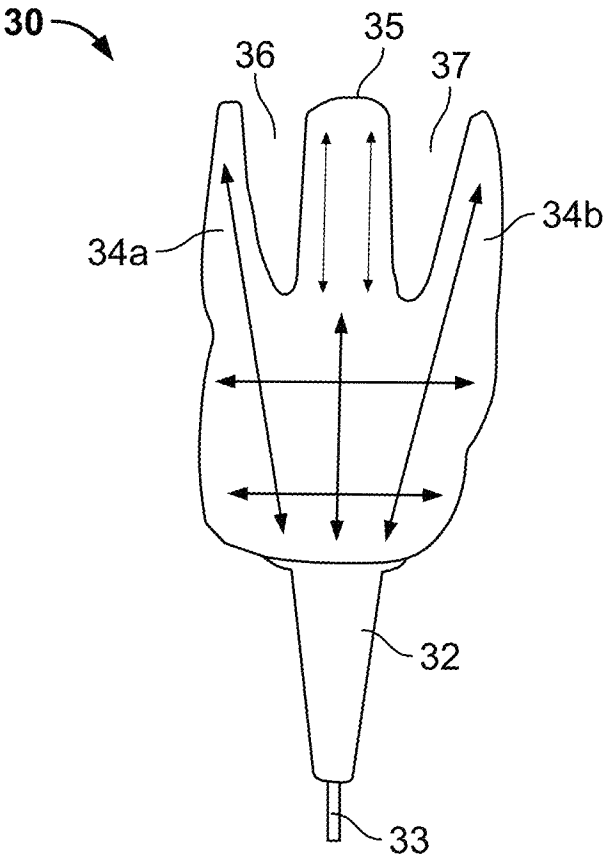
FIG. 2B shows a rear elevation view of the boot or shell portion of FIG. 2A in accordance with some embodiments of the present invention.
Figure 2A:
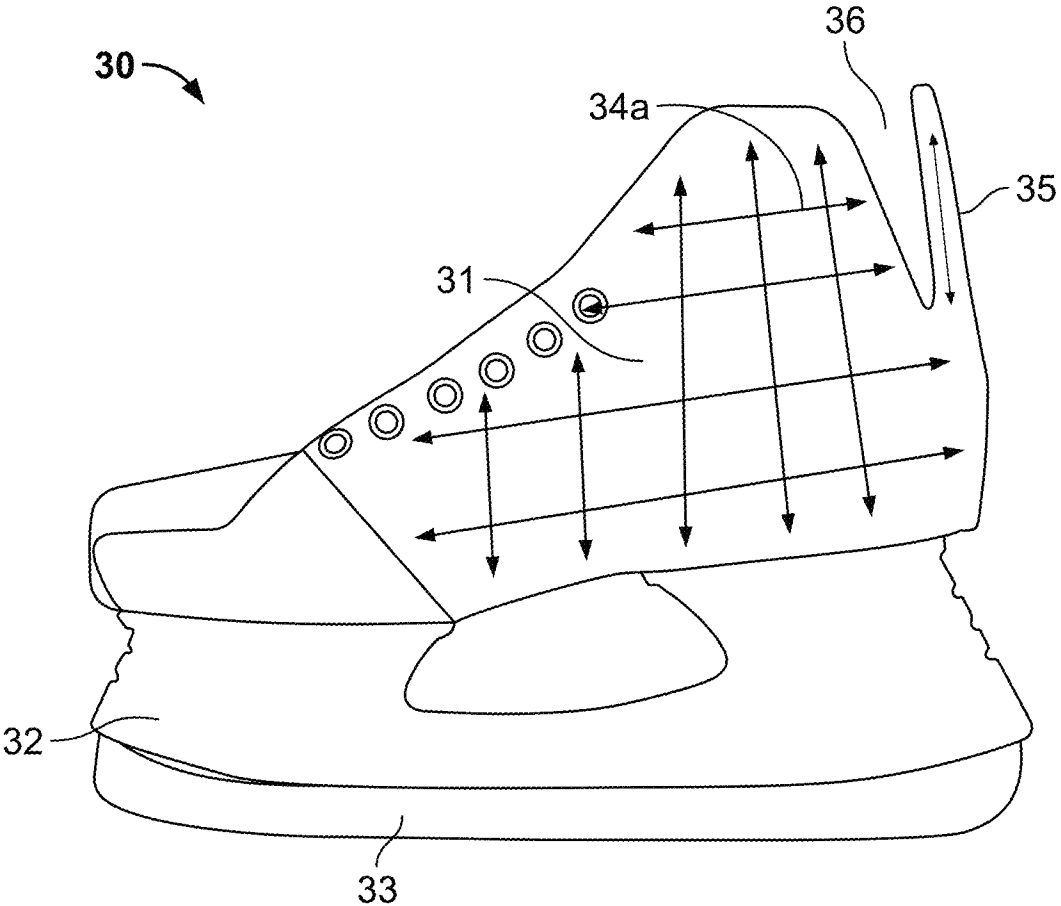
FIG. 2A shows a lateral side elevation view of a first exemplary boot or shell portion modified to include a composite flexible rail, in accordance with some embodiments of the present invention.
Figure 4:
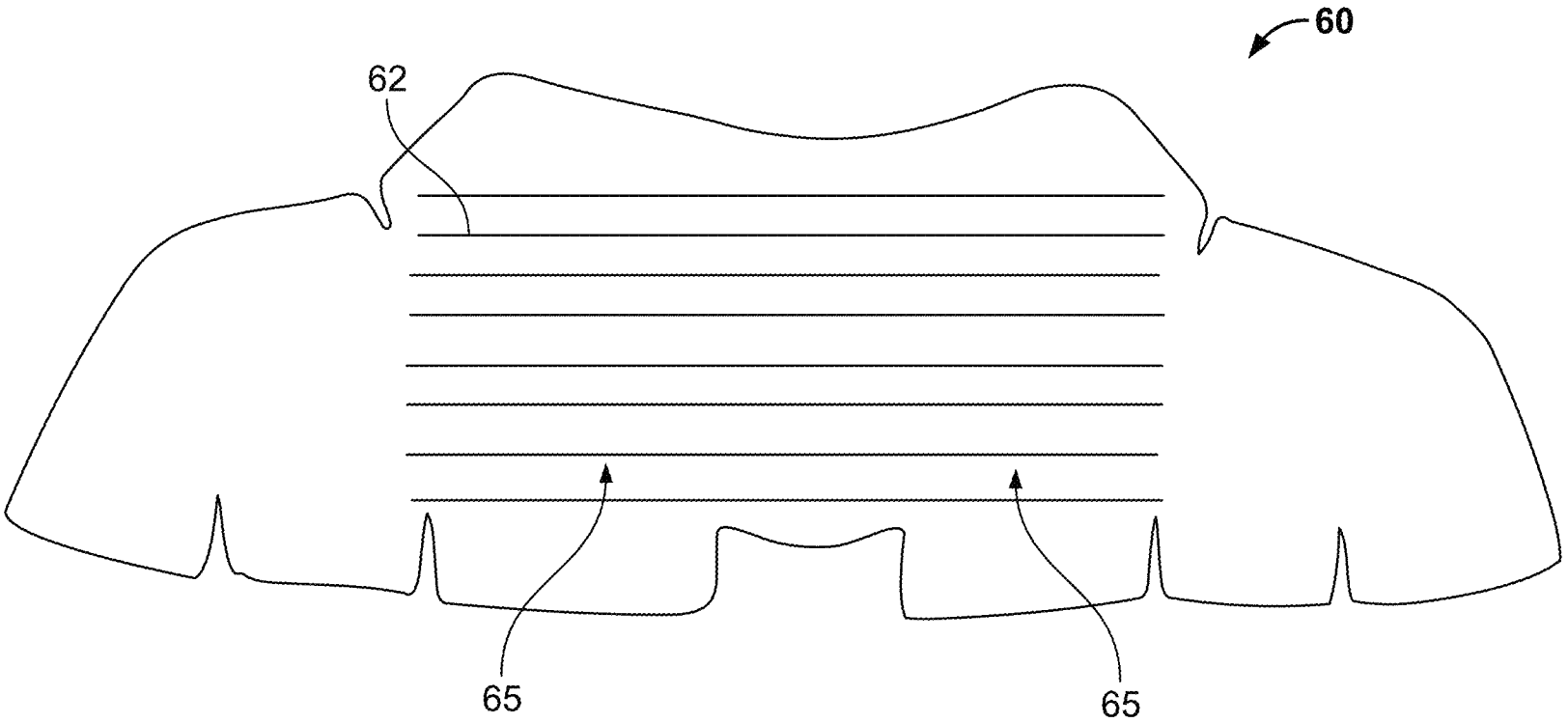
FIG. 4 shows a schematic of an illustrative embodiment of horizontal or substantially horizontal reinforcement for a heel region of a boot or shell portion, in accordance with some embodiments of the present invention.
Figure 5:
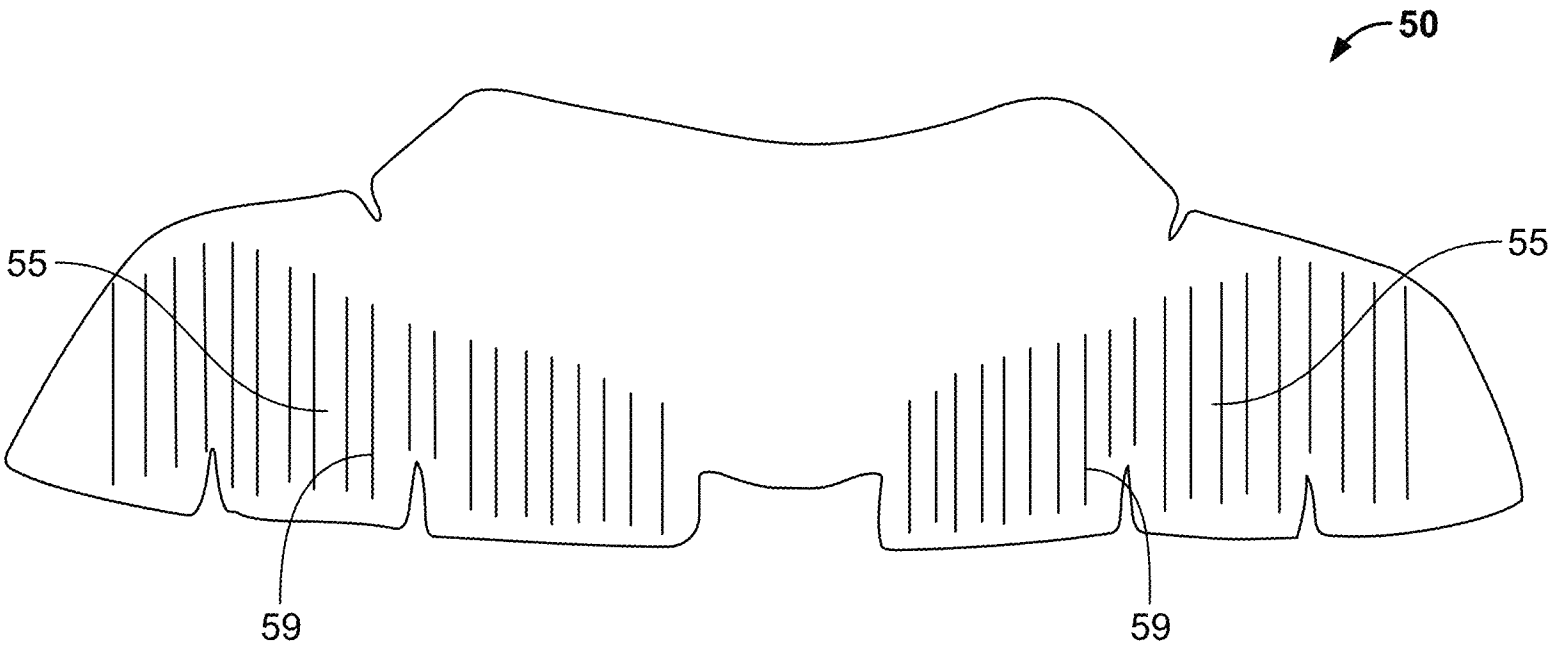
FIG. 5 shows a schematic of an illustrative embodiment of vertical or substantially vertical reinforcement for a quarter/midfoot region of a boot or shell portion, in accordance with some embodiments of the present invention.

Referring to FIGS. 2A, 2B, 3A, and 3B, a first embodiment of a modified article of footwear 30 is shown. As shown in FIGS. 2A and 2B, in some implementations, the article of footwear 30 may include a boot or shell portion ("boot shell") 31, a skate blade holder 32, and a blade 33. In some embodiments, the boot or shell portion 31 may be manufactured from a (e.g., rigid) composite material providing increased levels of stiffness and rigidity. More particularly, the boot or shell portion 31 may be manufactured from non-orthotropic fibers that may be asymmetric and/or unbalanced. As shown in FIG. 4, a mating component 60 for a skate boot or shell portion 31 may include a reinforcement 62. In some implementations, (e.g., horizontal or substantially horizontal) reinforcement 62 may be provided in the heel portion or region 65 of the skate boot or shell portion 31 to provide, inter alia, additional support to the ankle and the ankle area of the wearer. In addition, or alternatively, as shown in FIG. 5, a mating component 50 for a skate boot or shell portion 31 may include reinforcement 59. In some implementations, (e.g., vertical or substantially vertical) reinforcement 59 may be provided in the lower boot area 55 of the skate boot or shell portion 31 to provide, inter alia, lateral stiffness for the wearer's foot.

In some embodiments, the boot or shell portion (e.g., boot and shell portion 31) of an article of footwear described herein may be manufactured using techniques described in U.S. patent application Ser. No. 18/586,090, incorporated by reference herein in its entirety.

The (e.g., nylon, injection-molded) skate blade holder 32 may be structured and arranged to include a quick release mechanism that includes a trigger mechanism for releasably attaching the (e.g., stainless steel) blade 33 to the skate blade holder 32. Typically, the skate blade holder 32 may be riveted (e.g., using metal rivets) to the boot or shell portion 31 proximate the toe and heel portions of the boot or shell portion 31.

Unlike conventional articles of footwear 30, the lateral ankle portion 34*a* and the medial ankle portion 34*b* of the boot or shell portion 31 have been modified to create a (e.g., cantilevered) flange or flexible rail portion 35 proximate the user's Achilles heel and back ankle region in the heel portion of the article of footwear 30. As shown in FIGS. 2A and 2B, the flexible rail portion 35 may be an integral portion of the boot or shell portion 31. Alternatively, the flexible rail portion 35 may not be an integral portion of the boot or shell portion 31 and may be housed within, assembled into, and/or coupled (e.g., attached) to a sole portion (e.g., outsole) or heel portion of the boot or shell portion 31 of the article of footwear 30. In some variations, the flexible rail portion 35 may be attached to an upper heel portion and/or a lower Achilles heel portion of the heel portion of the boot or shell portion 31. Optionally, the flexible rail portion 35 may be removably attached to the boot or shell portion 31. Advantageously, the flexible rail portion 35 may be interchangeable (e.g., modular) to provide a desired level of stiffness. The flexible rail portion 35 may couple with the boot or shell portion 31 via a coupling mechanism including one or more of: rivets, fasteners (e.g., threaded fasteners, removable fasteners, etc.), an adjustable rachet system (e.g., including teeth and/or a pawl), adhesive, complementary features (e.g., male-female features), clips, and a hook and loop strap.

In some embodiments, the flexible rail portion 35 may be coupled to the boot or shell portion 31 via an intermediary structure. The intermediary structure may be housed within, assembled into, and/or coupled (e.g., attached) to a sole portion (e.g., outsole) or heel portion of the boot or shell portion 31 of the article of footwear 30. Optionally, the intermediary structure may be removably attached to the boot or shell portion 31. Advantageously, the intermediary structure may be interchangeable (e.g., modular) to provide a desired level of stiffness. In one example, the intermediary structure may be a rotational spring (e.g., metallic rotational spring).

As shown in FIGS. 2A and 2B, the (e.g., cantilevered) flange or flexible rail portion 35 may be separated from the lateral ankle portion 34*a* and the medial ankle portion 34*b* by a pair of (e.g., symmetric or asymmetric) gaps 36, 37. Typical gap distances may be constant or variable. For example, for variable gap distances, the gap distances may be tapered from top to bottom or from bottom to top and may vary from about 5 mm to about 50 mm. In some variations, a width of the flexible rail portion 35 may be uniform (e.g., constant) or variable (e.g., tapered). For example, a width of the flexible rail portion 35 may vary from top to bottom or from bottom to top, and may vary from about 5 mm to about 70 mm. In some variations, a width of the flexible rail portion 35 may be symmetric or asymmetric with respect to the lateral ankle portion 34*a* and the medial ankle portion 34*b*. Although FIGS. 2A and 2B show a flange or flexible rail portion 35 that extends to the top of the lateral ankle portion 34*a* and medial ankle portion 34*b* of the boot or shell portion 31, those of ordinary skill in the art can appreciate that the flexible rail portion 35 may also extend below or above the height of the lateral ankle portion 34*a* and medial ankle portion 34*b* of the boot or shell portion 31. In some embodiments, a height of the flexible rail portion 35 may be adjustable and controlled via a coupling mechanism that couples the flexible rail portion 35 to the boot or shell portion 31. For example, the flexible rail portion 35 may be raised or lowered along an axis extending upward or substantially upward, perpendicular or substantially perpendicular to the sole portion (e.g., outsole) and/or the skater's leg via an adjustable rachet system that couples the flexible rail portions 35 to the boot or shell portion 31.

In some embodiments, the flexible rail portion 35 may be manufactured from a material that can elastically deform and recover to an initial position, where the material provides an energy return when recovering to the initial position after elastic deformation. The flexible rail portion 35 may preferably be manufactured from composite materials including carbon fibers, glass fibers, natural fibers, thermoplastics, and/or thermosets. In some variations, the flexible rail portion 35 may be manufactured from materials including injection-molded plastics, thermoformable plastics, and/or metals (e.g., spring steel alloys, Nitinol, etc.). The flexible rail portion 35 may be manufactured from the same or different material(s) as the boot or shell portion 31. When the flexible rail portion 35 is integrated with the boot or shell portion 31, the flexible rail portion 35 may preferably be manufactured from the same material as the boot or shell portion 31. In some embodiments, the flexible rail portion 35 may be manufactured from a material that is rigid or substantially rigid and that does not elastically deform or otherwise elastically deforms less than the intermediary structure. The flexible rail portion 35 may be coupled to the boot or shell portion 31 via an intermediary structure, with the flexible rail portion 35 being rigid or substantially rigid, such that the flexible rail portion 35 does not elastically deform or otherwise elastically deforms less than the intermediary structure. In some embodiments, the flexible rail portion 35 is more rigid than the intermediary structure, such that flexible rail portion 35 biases elastic deformation toward the intermediary structure (e.g., during dorsiflexion of the leg).

Advantageously, in some embodiments, the (e.g., cantilevered) flange or flexible rail portion 35 can provide increased flexibility to the article of footwear 30 and consists of or consists essentially of a structural member that is fixed rigidly or semi-rigidly to the sole portion (e.g., outsole) or heel portion of the boot or shell portion 31 of the article of footwear 30, protruding upward or substantially upward, perpendicular or substantially perpendicular to the sole portion and/or in the same axis as the skater's leg. In some variations, the flexible rail portion 35 can include two or more (e.g., parallel or non-parallel) structural members that are fixed rigidly or semi-rigidly to the sole portion or heel portion of the boot or shell portion 31 of the article of footwear 30. In some variations, the flexible rail portion 35 can include one or more layers manufactured from the same or different materials. When connected to the leg via strapping or other material (e.g., the cuff/tendon guard), the flexible rail portion 35 is adapted to resist dorsiflexion of the leg. Advantageously, the flexible rail portion 35 has a relative stiffness high enough to support the user's body weight through dorsiflexion, imparting a bend and behaving like a spring such that any elastic deformation of the flexible rail portion 35 that occurs generates potential energy, which will be released when pressure is reduced or removed and the flexible rail portion 35 recovers to an original, neutral position and/or shape. Elastic deformation of the flexible rail portion 35 (e.g., by a user's body weight and/or dorsiflexion of the user's foot) may be referred to herein as a "loading phase" and a recovery of the flexible rail portion 35 from an elastically deformed position to an original position (also referred to herein as a "neutral position") may be referred to herein as an "unloading phase". Potential energy may be stored by the flexible rail portion 35 during the loading phase and the stored potential energy may be released by the flexible rail portion 35 during the unloading phase. Indeed, in some implementations, the flexible rail portion 35 may be structured and arranged to provide progressive flexure and energy storage during a loading phase of a skating stride, where the loading phase of the skating stride includes dorsiflexion of a wearer's foot to a dorsiflexed position and provide an energy return that is based on (e.g., positively correlated with) the energy storage during an unloading phase of the skating stride, where the unloading phase of the skating stride includes recovery of the wearer's foot to a neutral position from the dorsiflexed position. For example, the flexible rail portion 35 may be structured and arranged to provide progressive flexure of the article of footwear 30 in an anterior or forward direction of skating and provide an energy return in a posterior direction substantially opposite to the forward direction of skating. The stiffness of the flexible rail portion 35 may preferably be configured such that a user's mass is fully supported by the flexible rail portion 35 at the peak of dorsiflexion. In an embodiment, the flexible rail portion 35 may flex 5°-50° (e.g., preferably flex 10°-30°) in an anterior or forward direction of skating relative to a vertical axis (e.g., axis of a skater's leg or axis perpendicular to an outsole of the article of footwear 30). The flexible rail portion 35 may primarily flex (e.g., deflect) in an anterior or forward direction corresponding to a longitudinal axis of the article of footwear 30. In some variations, the flexible rail portion 35 may deflect in a medial or lateral direction during flexure (e.g., deflection) of the flexible rail portion 35 in an anterior or forward direction. A thickness of the flexible rail portion 35 may be uniform or variable over the length of the flexible rail portion 35, thereby providing uniform or variable stiffness of the flexible rail portion 35. For example, the flexible rail portion 35 may include one or more ribs or other stiffening features that form a variable thickness of the flexible rail portion 35. In an embodiment, a thickness of the flexible rail portion 35 may vary from 3 mm to 70 mm. The flexible rail portion 35 can reach the peak of dorsiflexion without muscular activation by the user as energy expenditure in this range of motion is inefficient with respect to the direction of motion.

Advantageously, when the (e.g., cantilevered) flange or flexible rail portion 35 is coupled to the boot or shell portion 31 via an intermediary component, the intermediary component can provide increased flexibility to the article of footwear 30 and consist of or consists essentially of a structural member that is fixed rigidly or semi-rigidly to the outsole or heel portion of the boot or shell portion 31 of the article of footwear 30. The flexible rail portion 35 coupled to the intermediary component may protrude upward or substantially upward, perpendicular or substantially perpendicular to the outsole and/or in the same axis as the skater's leg. In some variations, the flexible rail portion 35 can include one or more structural members that are fixed rigidly or semi-rigidly to the intermediary structure. When connected to the leg via strapping or other material, the intermediary component is adapted to resist dorsiflexion of the leg and the flexible rail portion 35 is adapted to resist elastic deformation. Advantageously, the intermediary component has a relative stiffness high enough to support the user's body weight through dorsiflexion, imparting a bend and/or behaving like a spring such that any elastic deformation of the intermediary component that occurs generates potential energy during a loading phase, which will be released during an unloading phase when pressure is reduced or removed and the intermediary component recovers to an original position and/or shape. Elastic deformation of the intermediary component (e.g., by a user's body weight and/or dorsiflexion of the user's foot) may be referred to herein as a "loading phase" and a recovery of the intermediary component from an elastically deformed position to an original position (also referred to herein as a "neutral position") may be referred to herein as an "unloading phase". Potential energy may be stored by the intermediary component during the loading phase and the stored potential energy may be released by the intermediary component during the unloading phase. Indeed, in some implementations, the intermediary component may be structured and arranged to provide progressive flexure and energy storage during a loading phase of a skating stride, where the loading phase of the skating stride includes dorsiflexion of a wearer's foot to a dorsiflexed position and provide an energy return that is based on (e.g., positively correlated with) the energy storage during an unloading phase of the skating stride, where the unloading phase of the skating stride includes recovery of the wearer's foot to a neutral position from the dorsiflexed position. For example, the intermediary component may be structured and arranged to provide progressive flexure of the article of footwear 30 in an anterior or forward direction of skating and provide an energy return in a posterior direction substantially opposite to the forward direction of skating. The stiffness of the intermediary component may preferably be configured such that a user's mass is fully supported by the intermediary component at the peak of dorsiflexion. The intermediary component can reach the peak of dorsiflexion without muscular activation by the user as energy expenditure in this range of motion is inefficient with respect to the direction of motion.

Figure 3B:
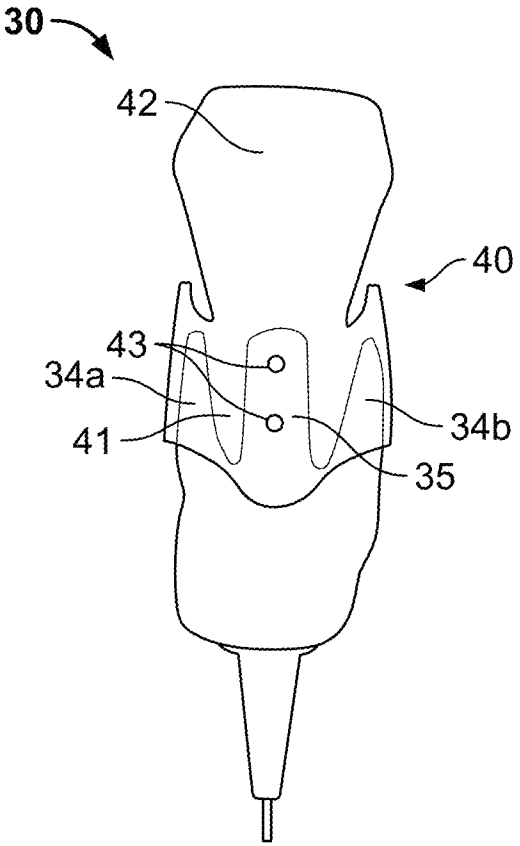
FIG. 3B shows a rear elevation view of the article of footwear of FIG. 3A, in accordance with some embodiments of the present invention.
Figure 3A:
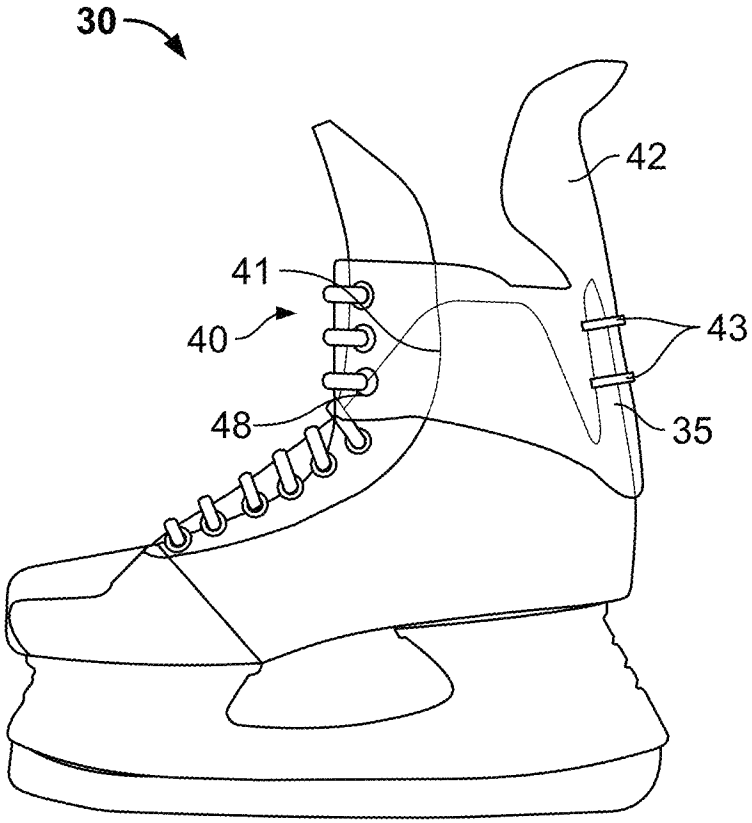
FIG. 3A shows a lateral side elevation view of an article of footwear having the boot or shell portion of FIG. 2A further including an integrated cuff/tendon guard, in accordance with some embodiments of the present invention.

Referring to FIGS. 3A and 3B, in some embodiments, the modified article of footwear 30 further includes a cuff/tendon guard ("tendon guard cuff") 40, structured and arranged to follow the contours of the boot or shell portion 31, is fixedly attached to the boot or shell portion 31 and, in some applications, to the flexible rail portion 35. Advantageously, in some variations, the tendon guard cuff 40 may be posteriorly biased when the article of footwear 30 is in an at-rest or neutral state. Optionally, the tendon guard cuff 40 may be removably attached to the boot or shell portion 31 and/or the flexible rail portion 35. Advantageously, the tendon guard cuff 40 may be interchangeable (e.g., modular) to provide a desired level of stiffness. In some variations, the tendon guard cuff 40 or a portion thereof may cover and/or surround at least a portion of an exterior of the boot or shell portion 31.

As shown in FIGS. 3A and 3B, the tendon guard cuff 40 may include a main (e.g., cuff) portion 41, an Achilles heel tendon portion 42, and a number of eyelets 48 for lacings. The eyelets 48 may be provided along a peripheries, e.g., edges, of the cuff portion 41 adjacent to medial and lateral ankle portions of the boot or shell portion 31. In some variations, the eyelets 48 of the tendon guard cuff 40 may be separate and distinct from the eyelets of the boot or shell portion 31. In some variations, individual eyelets 48 of the tendon guard cuff 40 may be or may not be adjacent to individual eyelets of the boot or shell portion 31 based on a structure and arrangement of the boot or shell portion 31. A number of fastening or connection devices (e.g., rivets, threaded fasteners, and the like) may be used to fixedly attach the tendon guard cuff 40 to the flexible rail portion 35 at one or more physical connection points 43. The position (s) of the one or more physical connection points 43 on the flexible rail portion 35 at which the tendon guard cuff 40 is connected may be selected based on a desired flexibility (e.g., stiffness) of the flexible rail portion 35 and/or the tendon guard cuff 40. For example, a physical connection point 43 positioned lower (e.g., toward the sole portion of the modified article of footwear 30) on the flexible rail portion 35 may increase the stiffness at which the flexible rail portion 35 and the tendon guard cuff 40 flexes during dorsiflexion of the modified article of footwear 30, while a physical connection point 43 positioned higher (e.g., away from the sole portion of the modified article of footwear 30) on the flexible rail portion 35 may reduce the stiffness at which the flexible rail portion 35 and the tendon guard cuff 40 flexes during dorsiflexion of the modified article of footwear 30. In the example illustrated in FIGS. 3A and 3B, one or both of the physical connection points can couple the tendon guard cuff 40 to the flexible rail portion 35. Optionally, instead of fixedly attaching the tendon guard cuff 40 to the flexible rail portion 35, the tendon guard cuff 40 may include a sleeve or pocket on its inner surface that is dimensioned to accommodate the flexible rail portion 35. The tendon guard cuff 40 may couple with the flexible rail portion 35 via a coupling mechanism including one or more of: rivets, fasteners (e.g., threaded fasteners, removable fasteners, etc.), an adjustable rachet system (e.g., including teeth and/or a pawl), adhesive, complementary features (e.g., male-female features), clips, and a hook and loop strap.

The article of footwear 30 may also include a tongue that may be selectively removable and/or interchangeable to provide a variety of levels of stiffness at the wearer's instep region.

In some embodiments, the tendon guard cuff 40 may have unitary, monolithic construction, such that the cuff portion 41 and the Achilles heel tendon portion 42 are combined as one structure to form the tendon guard cuff 40. In some variations, the tendon guard cuff 40 may be constructed from two or more structures. When the tendon guard cuff 40 is constructed from two or more structures, the two or more structures may be coupled to form the tendon guard cuff 40 prior to coupling the tendon guard cuff 40 to the boot or shell portion 31 or coupled to each other while coupled to the boot or shell portion 31. As an example, the cuff portion 41 and the Achilles heel tendon portion 42 may be separate, distinct structures that are joined using one or more fasteners to form the tendon guard cuff 40 prior to coupling the tendon guard cuff 40 to the boot or shell portion 31. In some embodiments, the tendon guard cuff 40 may be made of and/or include one or more materials, such as composite (e.g., thermoplastic composite), elastomer, foam, and/or plastic (e.g., thermoplastic) materials. As an example, the tendon guard cuff 40 may include a unitary thermoplastic injection molded structure forming the cuff portion 41 and the Achilles heel tendon portion 42 and a thermoplastic composite structure co-molded with the thermoplastic structure that extends across the cuff portion 41 and the Achilles heel tendon portion 42. As another example, the tendon guard cuff or a portion thereof may be made of and/or include a high-rebound plastic such as Pebax® polymer produced by ARKEMA.

Figure 6B:
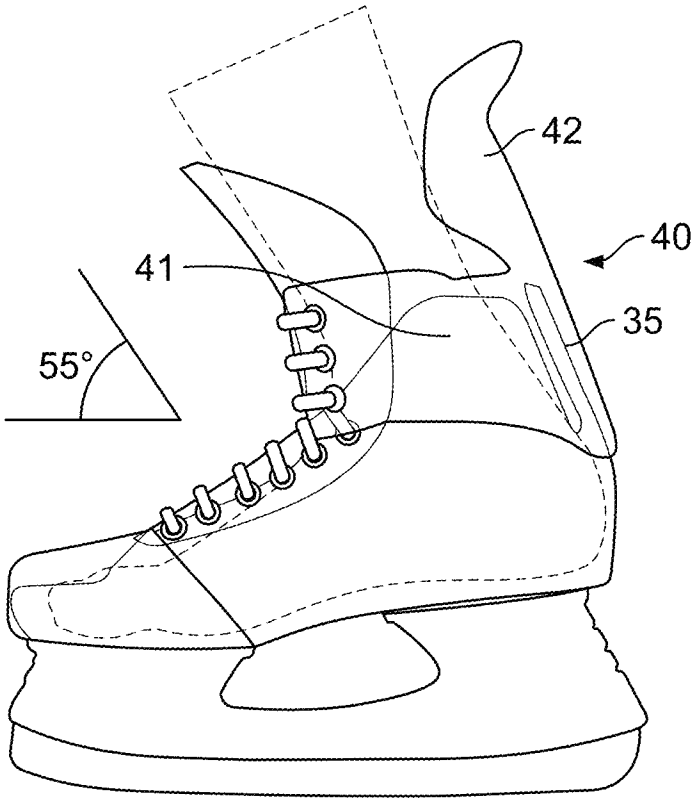
FIG. 6B shows a side view of a compression phase of a skater's stride during use, in accordance with some embodiments of the present invention.
Figure 6A:
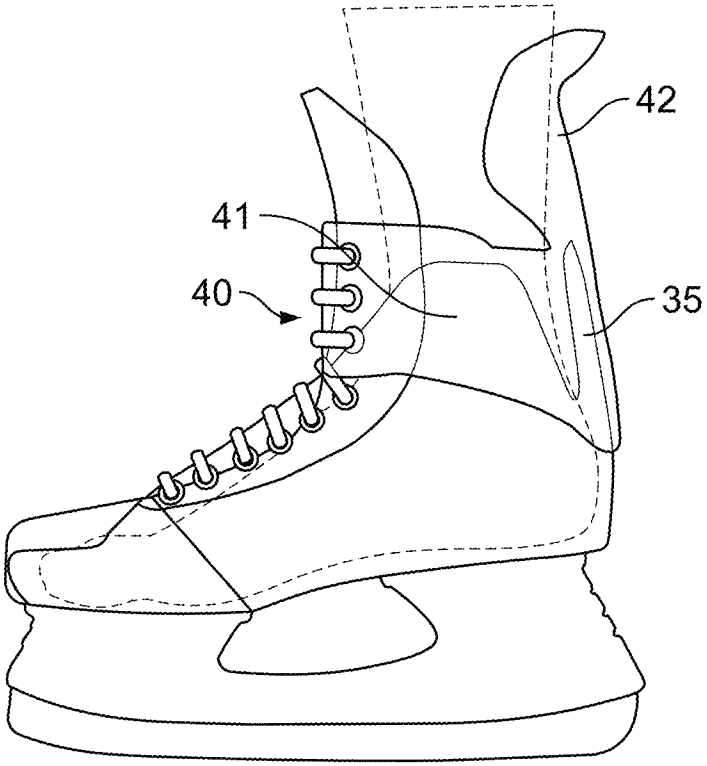
FIG. 6A shows a side view of a standing, neutral, or at-rest position phase of a skater's stride during use, in accordance with some embodiments of the present invention.
Figure 6F:
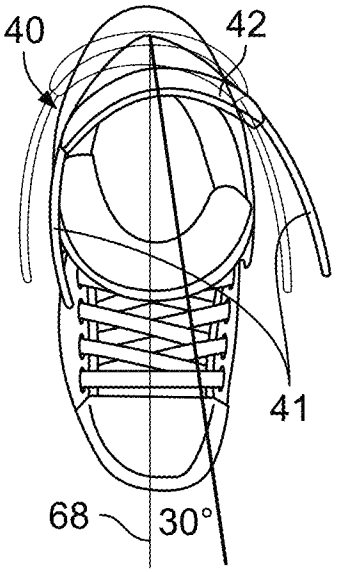
FIG. 6F shows a top view of a forward, medial compression phase of a skater's stride during use, in accordance with some embodiments of the present invention.
Figure 6E:
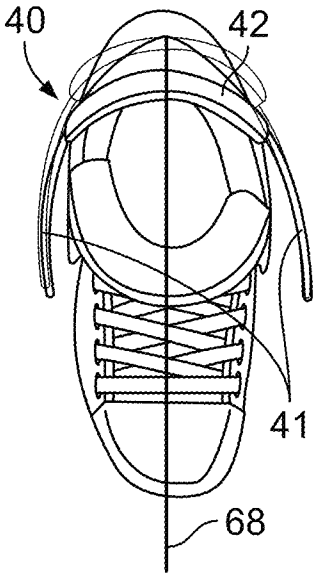
FIG. 6E shows a top view of a forward compression phase of a skater's stride during use, in accordance with some embodiments of the present invention.
Figure 6D:
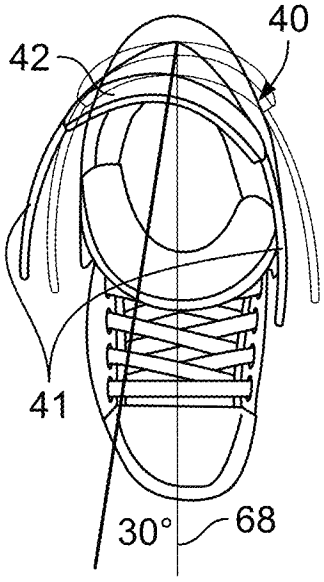
FIG. 6D shows a top view of a forward, lateral compression phase of a skater's stride during use, in accordance with some embodiments of the present invention.
Figure 6C:
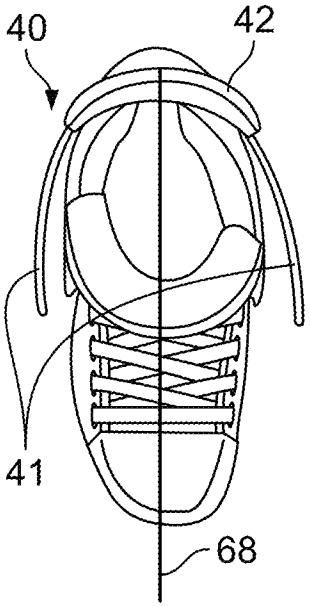
FIG. 6C shows a top view of a standing, neutral, or at-rest position phase of a skater's stride during use, in accordance with some embodiments of the present invention.

Advantageously, the tendon guard cuff 40 remains in position relative to the user's foot throughout the range of motion. FIGS. 6A and 6C each correspond to an at-rest, standing, or neutral state of a user's stride during use of the article of footwear, with the tendon guard cuff 40 remaining in position relative to the user's foot and a longitudinal axis 68 of the article of footwear throughout the range of motion. FIGS. 6B and 6E each correspond to an anterior dorsiflexion or compression state of a user's stride during use of the article of footwear, with the tendon guard cuff 40 remaining in position relative to the user's foot throughout the range of motion. FIGS. 6D and 6F correspond to an anterior, lateral dorsiflexion or compression state and an anterior, medial dorsiflexion or compression state, respectively of a user's stride during use of the article of footwear, with the tendon guard cuff 40 remaining in position relative to the user's foot throughout the range of motion. More particularly, the flexible rail portion 35 facilitates progressive forward flexure (FIGS. 6B, 6D, 6E, and 6F) in the tendon guard cuff 40 while providing energy for returning the flexible rail portion 35 to an at rest state (FIGS. 6A and 6C). More specifically, during the compression phase of a skater's stride, the skater dorsiflexes the tendon guard cuff 40, causing the flexible rail portion 35 to compress in an anterior direction, loading the flexible rail portion 35 with energy. When the skater enters an extension phase of their stride, the stored mechanical energy in the flexible rail portion 35 is returned to the skater, providing a mechanical assist to the stride. Advantageously, the Achilles heel tendon portion 42 remains close to the skater's Achilles heel tendon throughout the range of motion. As shown in FIGS. 6D and 6F, during the compression phase of a skater's stride, the tendon guard cuff 40 may flex laterally or medially (e.g., 30° laterally or medially) relative to a longitudinal axis 68 of the article of footwear (e.g., skate).

Figure 7:
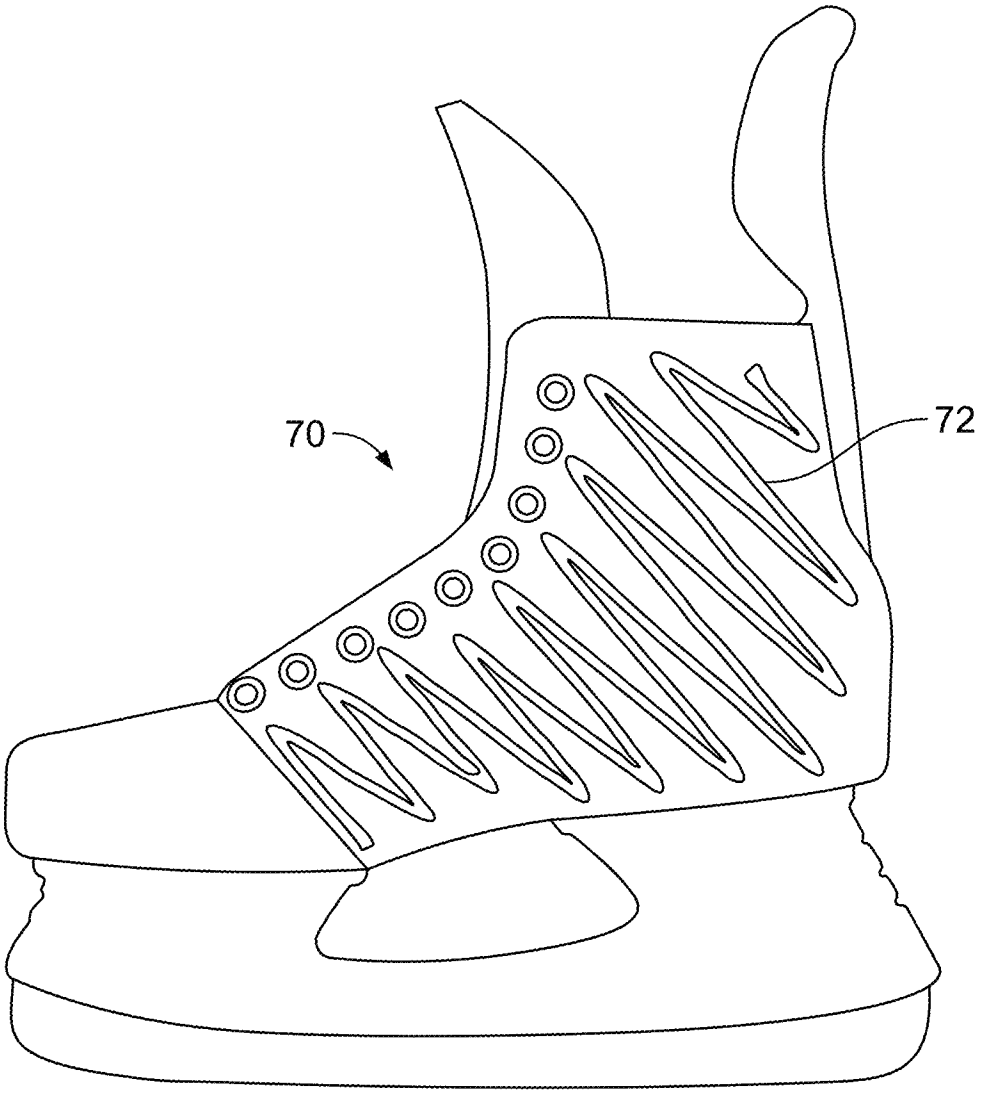
FIG. 7 shows a side view of an article of footwear integrated with a current-carrying wire, in accordance with some embodiments of the present invention.

As shown in FIG. 7, in some embodiments, the boot or shell portion ("boot shell") 70 may include a current-carrying wire 72. Advantageously, the wire 72 may be connected to a power source (not shown) to pass current through the wire 72 to warm the boot or shell portion 70. The wire 72 may warm the boot or shell portion 70 (e.g., strategic location(s) of the boot or shell portion 70) of the article of footwear to thermoform and adapt the boot or shell portion 70 to a shape of a user's foot. For example, prior or close to an initial use of the article of footwear including the boot or shell portion 70 and wire 72, the wire 72 may be connected to a power source to warm the boot or shell portion 70 and thermoform the boot or shell portion 70 to a shape of a wearer's foot. In some cases, warming of the boot or shell portion 70 via the wire 72 and power source may be performed to "preheat" the article of footwear for a wearer's foot. For example, when the article of footwear including the boot or shell portion 70 and wire 72 is exposed to a cool environment, the wire 72 may be connected to a power source to warm the boot or shell portion 70, thereby increasing comfort for a wearer of the article of footwear and/or increasing a flexibility article of footwear and the associated range of motion.

Boot or Shell Portion with Open Back Cuff

Figure 1B:
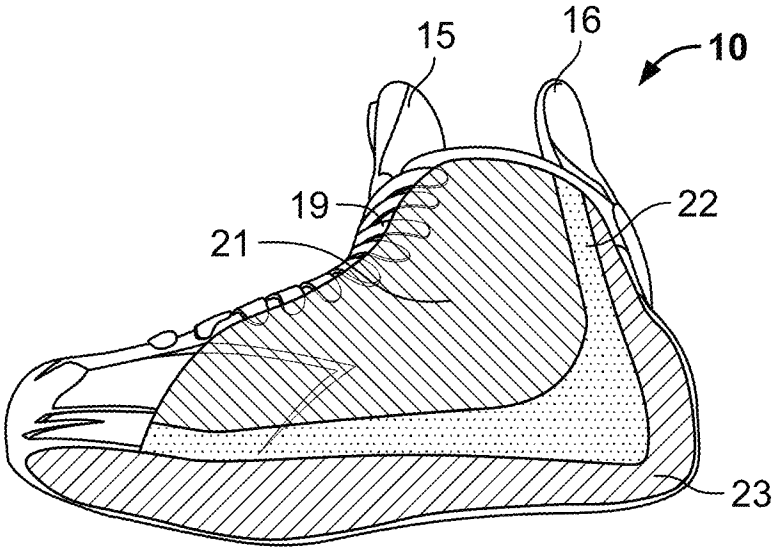
FIG. 1B (Prior Art)
FIG. 1B shows a bottom perspective view of the composite monocoque shell for a hockey skate of FIG. 1A, in accordance with the prior art.
Figure 1A:
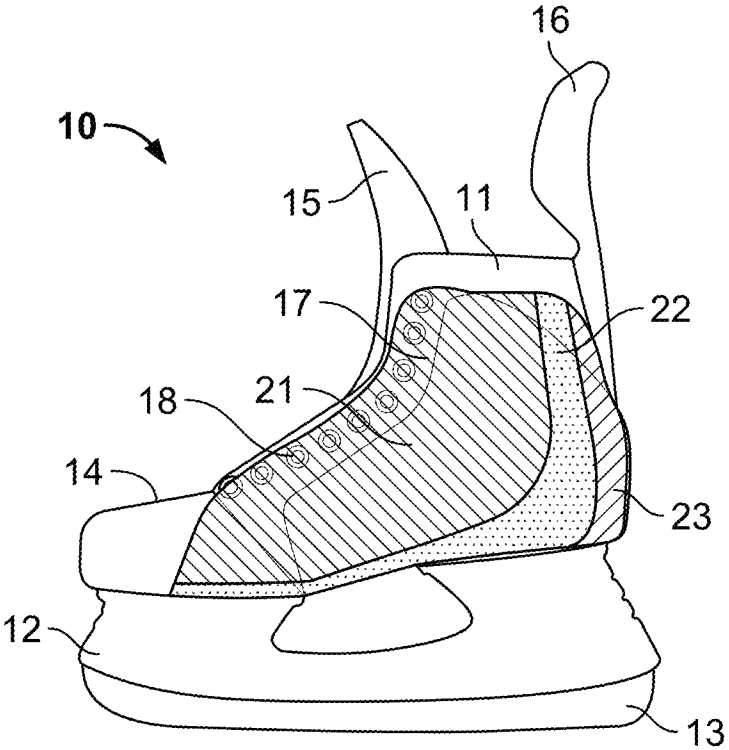
FIG. 1A (Prior Art)
FIG. 1A shows a lateral side elevation view of a monocoque-type hockey skate, in accordance with the prior art.
Figure 1D:
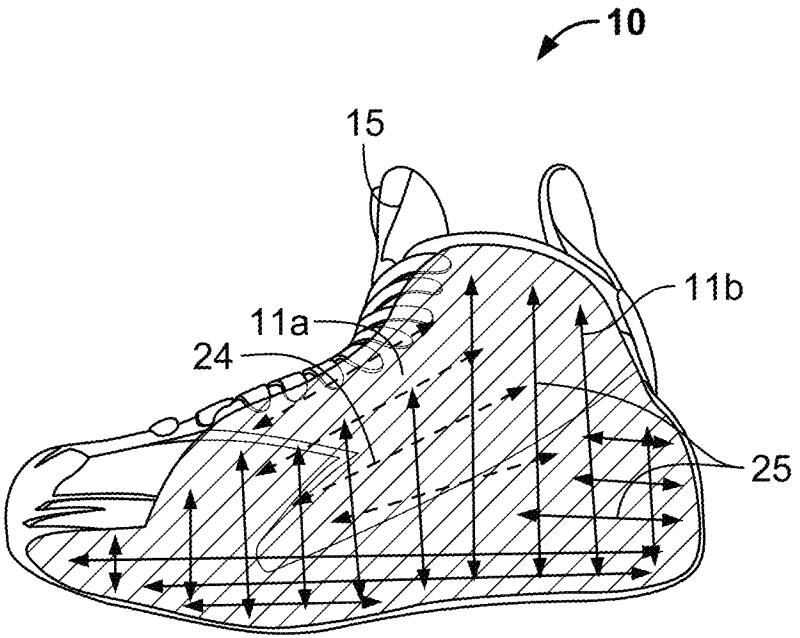
FIG. 1D (Prior Art)
FIG. 1D shows a bottom perspective view of the multi-directional distribution of rigidity and stiffness of FIG. 1C, in accordance with the prior art.
Figure 1C:
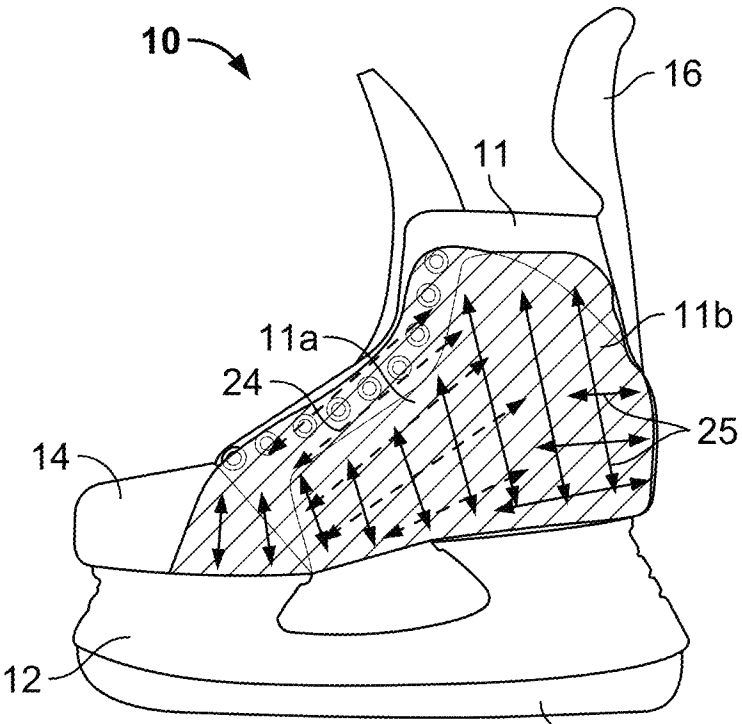
FIG. 1C (Prior Art)
FIG. 1C shows a multi-directional distribution of rigidity and stiffness of the composite monocoque shell for the hockey skate of FIG. 1A, in accordance with the prior art.
Figure 8C:
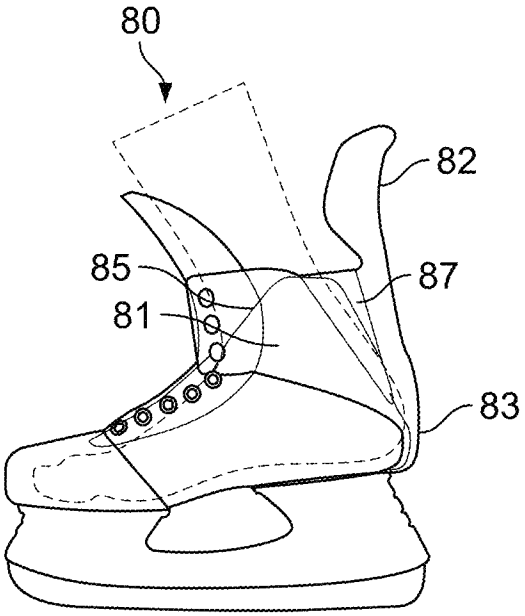
FIG. 8C shows a lateral side elevation view of the article of footwear of FIG. 8A in a compression phase of motion, in accordance with some embodiments of the present invention.
Figure 8B:
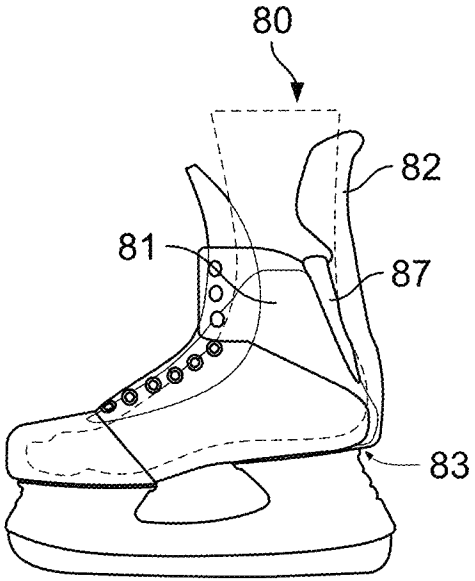
FIG. 8B shows a lateral side elevation view of the article of footwear of FIG. 8A in a neutral or at-rest state or phase of motion, in accordance with some embodiments of the present invention.
Figure 8A:
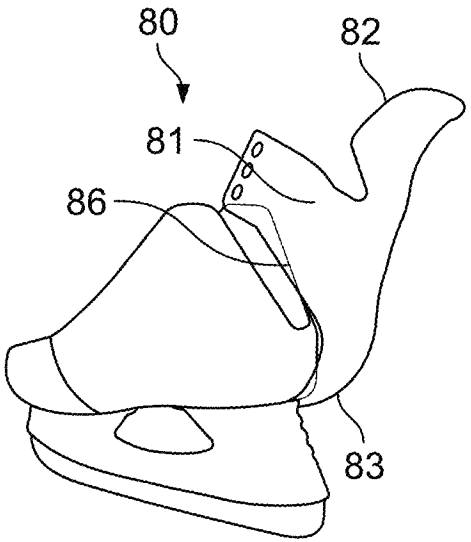
FIG. 8A shows a lateral side, rear perspective view of an article of footwear having an open back cuff, in accordance with some embodiments of the present invention.

Referring to FIGS. 8A-8C, another embodiment of a modified article of footwear 80 includes a boot or shell portion that includes features of the boot or shell portion 11 of FIGS. 1A and 1B modified by removal of a (e.g., first) portion 85 of the reinforcement portion 17 proximate the user's instep, i.e., at the opening for inserting the skater's foot proximate the medial and lateral ankle portions of the boot or shell portion 11, and a (e.g., second) portion 86 of the reinforcement portion 17 proximate the user's Achilles heel in the heel portion of the modified article of footwear 80 (e.g., hockey skate), as well as a number (e.g., three) of the eyelets 18 from each reinforcement portion 17. As shown in FIG. 8A, the removed (e.g., second) portion 86 is open and exposed. The boot or shell portion of the article of footwear 80 can include a lower heel portion, with the medial and lateral ankle portions of the boot or shell portion defining an opening disposed above the lower heel portion. The opening, e.g., formed by removal of a portion 86 from the boot or shell portion 11, can be defined by sloped edges of the medial and lateral ankle portions of the boot or shell portion, with the opening being proximate the user's Achilles heel and back ankle region in the heel portion of the article of footwear 80.

In some applications, the modified article of footwear 80 further includes a (e.g., thermoplastic composite and the like) cuff/tendon guard ("tendon guard cuff") including a main (e.g., cuff) portion 81 and an Achilles heel tendon portion 82. In some embodiments, as discussed above with respect to FIGS. 3A and 3B, the tendon guard cuff may have unitary, monolithic construction, such that the cuff portion 81 and the Achilles heel tendon portion 82 are combined as one structure to form the tendon guard cuff. In some variations, the tendon guard cuff may be constructed from two or more structures. In some variations, the main cuff portion 81 and Achilles heel tendon portion 82 are fixedly attached (e.g., using a rivet and the like at one or more physical points) to the boot or shell portion of the modified article of footwear 80 at an attachment point 83 located at the bottom of the heel portion of the modified article of footwear 80, generally between the insole of the modified article of footwear 80 and the skate blade holder 12. In some variations, the attachment point 83 may be a point of rotation. Fastener(s) that attach the cuff portion 81 and Achilles heel tendon portion 82 to the boot or shell portion of the modified article of footwear 80 at the attachment point 83 may be the same fastener(s) that attach the skate blade holder 12 to the bottom of the heel portion of the modified article of footwear 80. In some variations, the cuff portion 81 and Achilles heel tendon portion 82 are fixedly attached (e.g., using a rivet and the like at one or more physical points) to the boot or shell portion of the modified article of footwear 80 at an attachment point located at a lower heel/quarter portion of the modified article of footwear 80. In other variations, the cuff portion 81 and Achilles heel tendon portion 82 are fixedly attached to the boot or shell portion of the modified article of footwear 80 at an attachment point (not shown) located at the bottom of the heel portion of the modified article of footwear 80, generally on an exterior surface of the skate blade holder 12. The cuff portion 81 and Achilles heel tendon portion 82 may be fixedly attached to the boot or shell portion of the modified article of footwear 80 by a coupling mechanism including one or more of: rivets, fasteners (e.g., threaded fasteners, removable fasteners, etc.), an adjustable rachet system (e.g., including teeth and/or a pawl), adhesive, complementary features (e.g., male-female features), clips, and a hook and loop strap.

Advantageously, as shown in FIG. 8A, the cuff portion 81 and Achilles heel tendon portion 82 are structured and arranged to pivot about an axis of a skater's ankle based on the attachment point 83 to allow easier foot access to put on and take off the modified article of footwear 80 (e.g., hockey skate). In some variations, the cuff portion 81 and Achilles heel tendon portion 82 may be configured to bend, deflect, and/or flexibly deform relative to an axis of a skater's foot or ankle. Dorsiflexion of a skater's foot may cause localized or distributed deflection (e.g., relative to a skater's foot or ankle) of the cuff portion 81 and Achilles heel tendon portion 82 about an area proximate (e.g., above) the attachment point 83.

As shown in FIGS. 8B-8C, a tensile (e.g., elastic) structure 87 may be included in the modified article of footwear 80. In some variations, the cuff portion 81 or a portion thereof may be or include the tensile structure 87. The tensile structure 87 may be manufactured from elastomer, foam, and/or plastic materials. The tensile structure 87 may be structured and arranged to primarily flex (e.g., via elastic deformation) in an anterior or forward direction corresponding to a longitudinal axis of the modified article of footwear 80. Elastic deformation of the tensile structure 87 (e.g., by a user's body weight and/or dorsiflexion of the user's foot) may be referred to herein as a "loading phase" and a recovery of the tensile structure 87 from an elastically deformed position to an original position (also referred to herein as a "neutral position") may be referred to herein as an "unloading phase". Potential energy may be stored by the tensile structure 87 during the loading phase and the stored potential energy may be released by the tensile structure 87 during the unloading phase. The tensile structure 87 facilitates progressive forward flexure and energy storage during a loading phase of a skating stride, where the loading phase of the skating stride includes dorsiflexion of a wearer's foot to a dorsiflexed position and provides an energy return that is based on the energy storage during an unloading phase of the skating stride, where the unloading phase of the skating stride includes recovery of the wearer's foot to a neutral position from the dorsiflexed position. For example, the flexible rail portion tensile structure may be structured and arranged to provide progressive forward flexure (FIG. 8C) of, inter alia, the cuff portion 81 while providing and storing mechanically energy for returning the cuff portion 81 to a neutral or at-rest state (FIG. 8B). A tensile structure 87 may be (e.g., symmetrically or asymmetrically) included on opposing (e.g., medial and lateral) sides of an Achilles heel tendon portion 82 of the cuff portion 81. Mechanical energy is stored by the tensile structure 87 during extension of the tensile structure 87 and mechanical energy is returned during contraction of the tensile structure 87.

Boot or Shell Portion and Cuff/Tendon Guard with Flexible Rail Portion

Figure 9B:
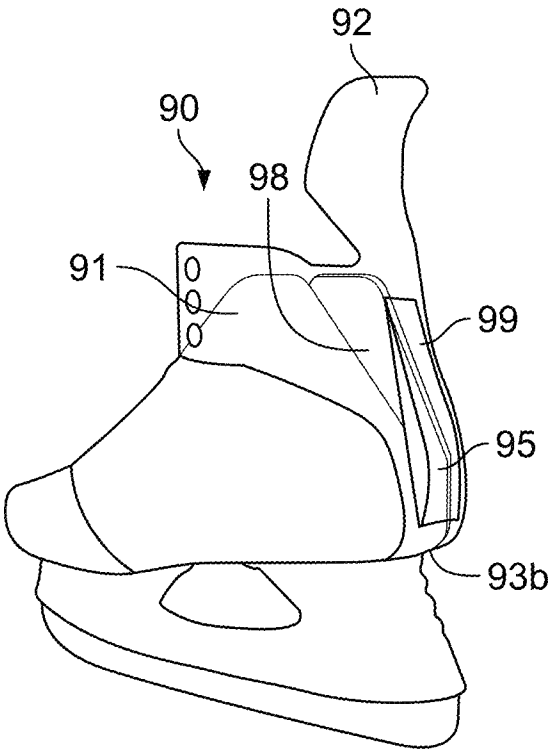
FIG. 9B shows a lateral side, rear perspective view of an article of footwear having an open back cuff including a composite flexible rail, in accordance with some embodiments of the present invention.
Figure 9A:
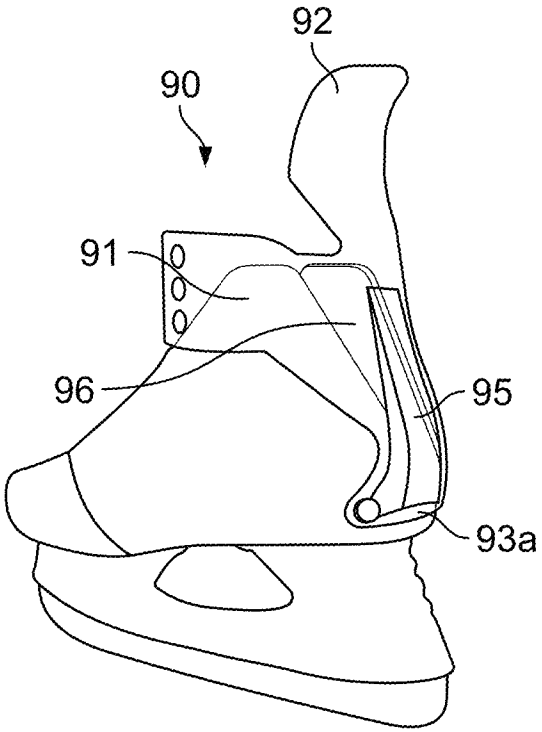
FIG. 9A shows a lateral side, rear perspective view of an article of footwear having an open back cuff including a composite flexible rail, in accordance with some embodiments of the present invention.

Referring to FIGS. 9A, 9B, 9C, and 9D, yet another embodiment of a modified article of footwear 90 includes a boot or shell portion that include features of the boot or shell portion 11 of FIGS. 1A and 1B modified by removal of a (e.g., first) portion 97 of the reinforcement portion 17 proximate the user's instep, i.e., at the opening for inserting the skater's foot proximate the medial and lateral ankle portions of the boot or shell portion 11, and a (e.g., second) portion 96 of the reinforcement portion proximate the user's Achilles heel in the heel portion of the modified article of footwear 90 (e.g., hockey skate), as well as a number (e.g., three) of the eyelets 18 from each reinforcement portion 17. As shown in FIG. 9A, the removed (e.g., second) portion 96 is open and exposed. The boot or shell portion of the article of footwear 90 can include a lower heel portion, with the medial and lateral ankle portions of the boot or shell portion defining an opening disposed above the lower heel portion. The opening, e.g., defined by removal of a portion 96 from the boot or shell portion 11, can be defined by sloped edges of the medial and lateral ankle portions of the boot or shell portion, with the opening being proximate the user's Achilles heel and back ankle region in the heel portion of the article of footwear 90.

Figure 9D:
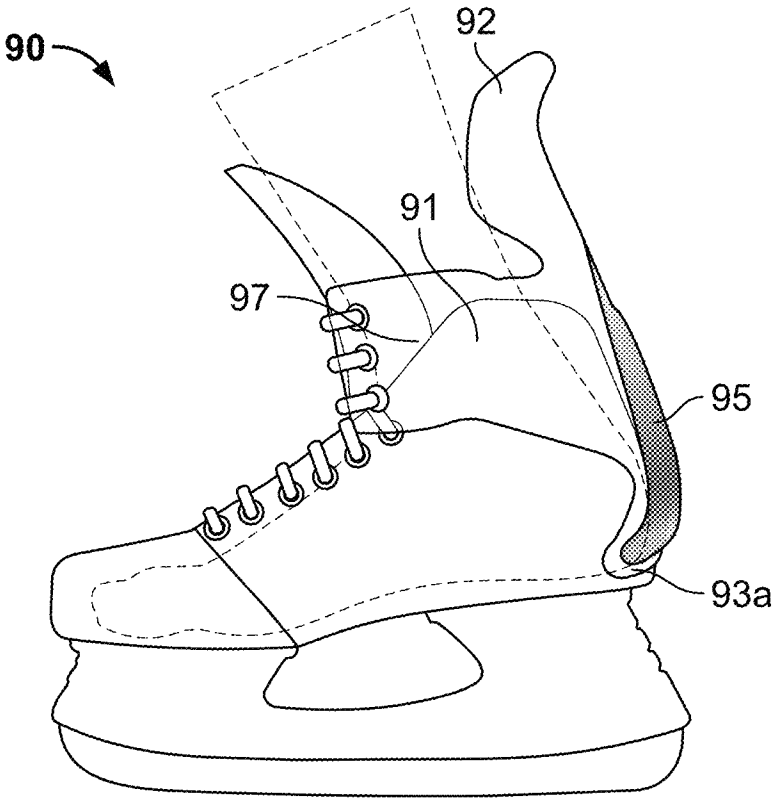
FIG. 9D shows a lateral side elevation view of the article of footwear of FIG. 9A in a compression phase of motion, in accordance with some embodiments of the present invention.
Figure 9C:
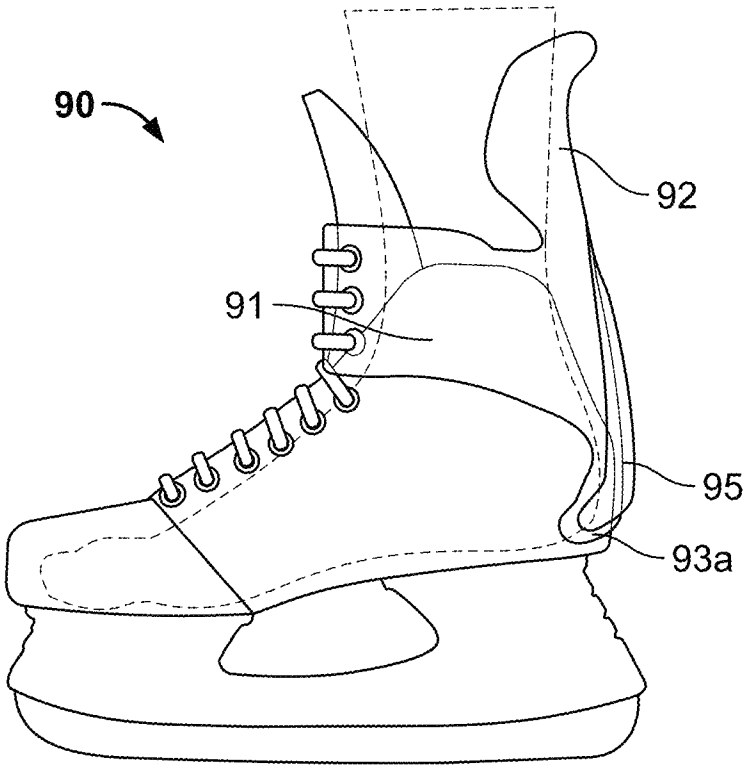
FIG. 9C shows a lateral side elevation view of the article of footwear of FIG. 9A in a neutral or at-rest state or phase of motion, in accordance with some embodiments of the present invention.

In some applications, the modified article of footwear 90 further includes a (e.g., thermoplastic composite and the like) cuff/guard ("tendon guard cuff") including a main (e.g., cuff) portion 91 and an Achilles heel tendon portion 92. In some embodiments, as discussed above with respect to FIGS. 3A and 3B, the tendon guard cuff may have unitary, monolithic construction, such that the cuff portion 91 and the Achilles heel tendon portion 92 are combined as one structure to form the tendon guard cuff. In some variations, the tendon guard cuff may be constructed from two or more structures. The main cuff portion 91 and Achilles heel tendon portion 92 may be fixedly attached (e.g., using a rivet and the like at one or more physical points) to the boot or shell portion of the modified article of footwear 90 at an attachment point 93*a* or 93*b*. In some variations, the attachment points 93*a* and 93*b* are respective points of rotation. In some variations, as shown in FIGS. 9A, 9C, and 9D, the cuff portion 91 and Achilles heel tendon portion 92 are fixedly attached to the boot or shell portion of the modified article of footwear 90 at an attachment point 93*a* located at a lower heel/quarter portion of the modified article of footwear 90. In other variations, the cuff portion 91 and Achilles heel tendon portion 92 are fixedly attached to the boot or shell portion of the modified article of footwear 90 at an attachment point 93*b* located at the bottom of the heel portion of the modified article of footwear 90, generally between the insole of the modified article of footwear 90 and the skate blade holder 12. In other variations, the cuff portion 91 and Achilles heel tendon portion 92 are fixedly attached to the boot or shell portion of the modified article of footwear 90 at an attachment point (not shown) located at the bottom of the heel portion of the modified article of footwear 90, generally on an exterior surface of the skate blade holder 12.

Advantageously, as shown in FIGS. 9A-9D, the cuff portion 91 and Achilles heel tendon portion 92 are structured and arranged to pivot with respect to an axis of a skater's ankle, about the attachment points 93*a* or 93*b* to allow easier foot access to put on and take off the modified article of footwear 90 (e.g., hockey skate). In some variations, the cuff portion cuff portion 91 and Achilles heel tendon portion 92 may be configured to bend, deflect, and/or flexibly deform relative to an axis of a skater's foot or ankle. Dorsiflexion of a skater's foot may cause localized or distributed deflection (e.g., relative to a skater's foot or ankle) of the cuff portion 91 and Achilles heel tendon portion 92 about an area proximate (e.g., above) the attachment point (e.g., attachment points 93*a* or 93*b*).

As shown in FIGS. 9A-9D, the cuff portion 91 and Achilles heel tendon portion 92 may include an integrated flange or flexible rail portion 95 positioned proximate the user's Achilles heel and back ankle region in the heel portion of the modified article of footwear 90. The cuff portion 91 and Achilles heel tendon portion 92 may include a sleeve or pocket on its inner surface that is dimensioned to fixedly accommodate the flexible rail portion 95. As shown in FIGS. 9A-9D, the flexible rail portion 95 may be an integral portion of the cuff portion 91 and Achilles heel tendon portion 92. Alternatively, the flexible rail portion 95 may not be an integral portion of the cuff portion 91 and Achilles heel tendon portion 92 and may be assembled into and/or coupled to an interior surface or an exterior surface of a heel portion of the cuff portion 91 of the modified article of footwear 90. Optionally, the flexible rail portion 95 may be removably attached to the cuff portion 91 and Achilles heel tendon portion 92. Advantageously, the flexible rail portion 95 may be interchangeable (e.g., modular) to provide a desired level of stiffness.

As shown in FIGS. 9A and 9B, a top portion of the flexible rail portion 95 may be separated from the lateral ankle portion and the medial ankle portion of the boot or shell portion of the modified article of footwear 90 by a pair of (e.g., symmetric or asymmetric) gaps 98, 99. Typical gap distances may be constant or variable. For example, for variable gap distances, the gap distances may be tapered from top to bottom or from bottom to top and may vary from about 5 mm to about 50 mm. In some variations, a width of the flexible rail portion 95 may be uniform (e.g., constant) or variable (e.g., tapered). For example, a width of the flexible rail portion 95 may vary from top to bottom or from bottom to top and may vary from about 5 mm to about 70 mm. In some variations, a width of the flexible rail portion 95 may be symmetric or asymmetric with respect to the lateral ankle portion and the medial ankle portion. Although FIGS. 9A-9D show a flange or flexible rail portion 95 that extends to the top of the lateral and medial ankle portions of the boot or shell portion, those of ordinary skill in the art can appreciate that the flexible rail portion 95 may also extend to or above the height of the lateral and medial ankle portions of the boot or shell portion.

The flexible rail portion 95 may be manufactured from a material that can elastically deform and recover to an initial position, with the material providing an energy return when recovering to the initial position after elastic deformation. The flexible rail portion 95 may preferably be manufactured from composite materials, such as carbon fibers, glass fibers, natural fibers, thermoplastics, and/or thermosets. In some variations, the flexible rail portion 95 may be manufactured from materials including injection-molded plastics, thermoformable plastics, and/or metals (e.g., spring steel alloys, Nitinol, etc.).

Advantageously, the flexible rail portion 95 can provide increased flexibility to the modified article of footwear 90 and consists of or consists essentially of a structural member that is fixed rigidly or semi-rigidly to an interior (e.g., interior sleeve or pocket) or exterior of the cuff portion 91 and Achilles heel tendon portion 92 of the modified article of footwear 90. In some variations, the flexible rail portion 95 can include two or more (e.g., parallel or non-parallel) structural members that are fixed rigidly or semi-rigidly to an interior (e.g., interior sleeve or pocket) or exterior of the cuff portion 91 and Achilles heel tendon portion 92 of the modified article of footwear 90. In some variations, the flexible rail portion 95 can include one or more layers manufactured from the same or different materials. The flexible rail portion 95 may protrude upward or substantially upward, perpendicular or substantially perpendicular to the outsole and/or in the same axis as the skater's leg. When connected to the leg via strapping or other material (e.g., the cuff/tendon guard), the flexible rail portion 95 is adapted to resist dorsiflexion of the leg. Advantageously, the flexible rail portion 95 has a relative stiffness high enough to support the user's body weight through dorsiflexion, imparting a bend and behaving like a spring such that any elastic deformation of the flexible rail portion 95 that occurs generates potential energy, which will be released when pressure is reduced or removed and the flexible rail portion 95 recovers to an original position and/or shape. Indeed, in some implementations, the flexible rail portion 95 may be structured and arranged to provide progressive flexure and energy storage during a loading phase of a skating stride, where the loading phase of the skating stride includes dorsiflexion of a wearer's foot to a dorsiflexed position and provide an energy return that is based on (e.g., positively correlated with) the energy storage during an unloading phase of the skating stride, where the unloading phase of the skating stride includes recovery of the wearer's foot to a neutral position from the dorsiflexed position. For example, the flexible rail portion 95 may be structured and arranged to provide progressive flexure of the modified article of footwear 90 in an anterior or forward direction of skating and provide an energy return in a posterior direction substantially opposite to the forward direction of skating. The stiffness of the flexible rail portion 95 may preferably be configured such that a user's mass is fully supported by the flexible rail portion 95 at the peak of dorsiflexion. In an embodiment, the flexible rail portion 95 may flex 5°-50° (e.g., preferably flex 10°-30°) in an anterior or forward direction of skating relative to a vertical axis (e.g., axis of a skater's leg or axis perpendicular to an outsole of the article of footwear 90). The flexible rail portion 95 may primarily flex (e.g., deflect) in an anterior or forward direction corresponding to a longitudinal axis of the article of footwear. In some variations, the flexible rail portion 95 may deflect in a medial or lateral direction during flexure (e.g., deflection) of the flexible rail portion 95 in an anterior or forward direction. A thickness of the flexible rail portion 95 may be uniform or variable over the length of the flexible rail portion 95, thereby providing uniform or variable stiffness of the flexible rail portion 95. For example, the flexible rail portion 95 may include one or more ribs or other stiffening features that form a variable thickness of the flexible rail portion 95. In an embodiment, a thickness of the flexible rail portion 95 may from 3 mm to 30 mm. The flexible rail portion 95 can reach the peak of dorsiflexion without muscular activation by the user as energy expenditure in this range of motion is inefficient with respect to the direction of motion.

Advantageously, the cuff portion 91 and Achilles heel tendon portion 92 remains in position relative to the user's foot throughout the range of motion. More particularly, as shown in FIGS. 9C and 9D, corresponding to an at-rest, standing, or neutral state and to an anterior dorsiflexion or compression state, respectively, the flexible rail portion 95 facilitates progressive forward flexure (FIG. 9D) in the cuff portion 91 while providing energy for returning the flexible rail portion 95 to an at rest state (FIG. 9C). More specifically, during the compression phase of a skater's stride, the skater dorsiflexes the cuff portion 91 and Achilles heel tendon portion 92, causing the flexible rail portion 95 to compress in an anterior direction, loading the flexible rail portion 95 with energy. When the skater enters an extension phase of their stride, the stored mechanical energy in the flexible rail portion 95 is returned to the skater, providing a mechanical assist to the stride. Advantageously, the Achilles heel tendon portion 92 remains close to the skater's Achilles heel tendon throughout the range of motion.

Boot or Shell Portion with an Elastomer Cuff

Figure 10B:
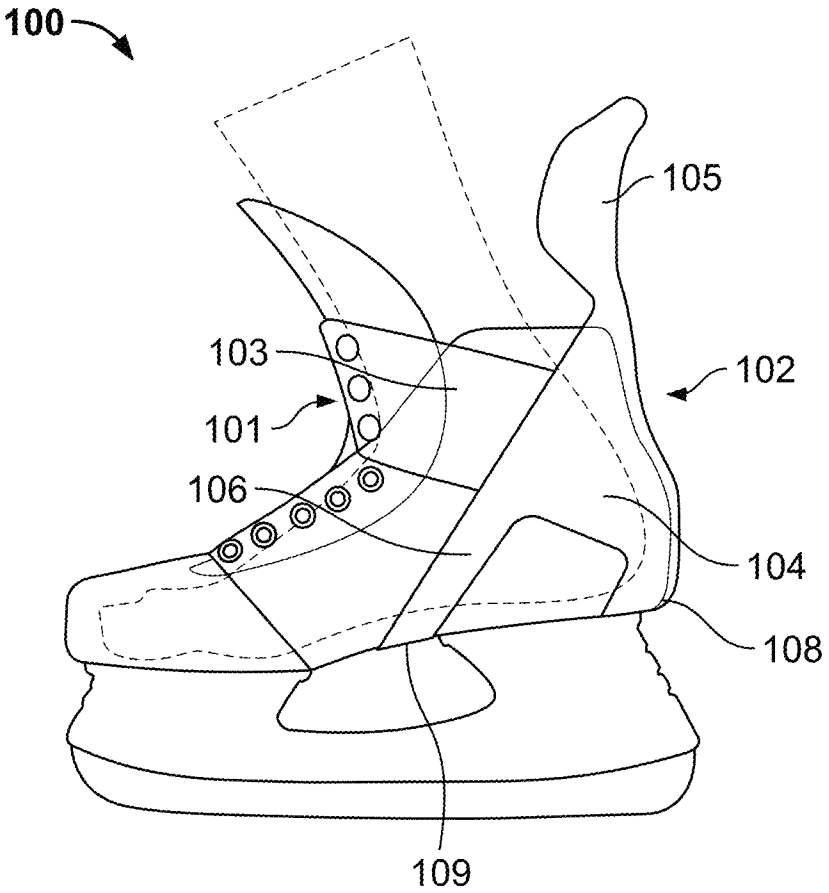
FIG. 10B shows a lateral side elevation view of the article of footwear of FIG. 10A in a compression phase of motion, in accordance with some embodiments of the present invention.
Figure 10A:
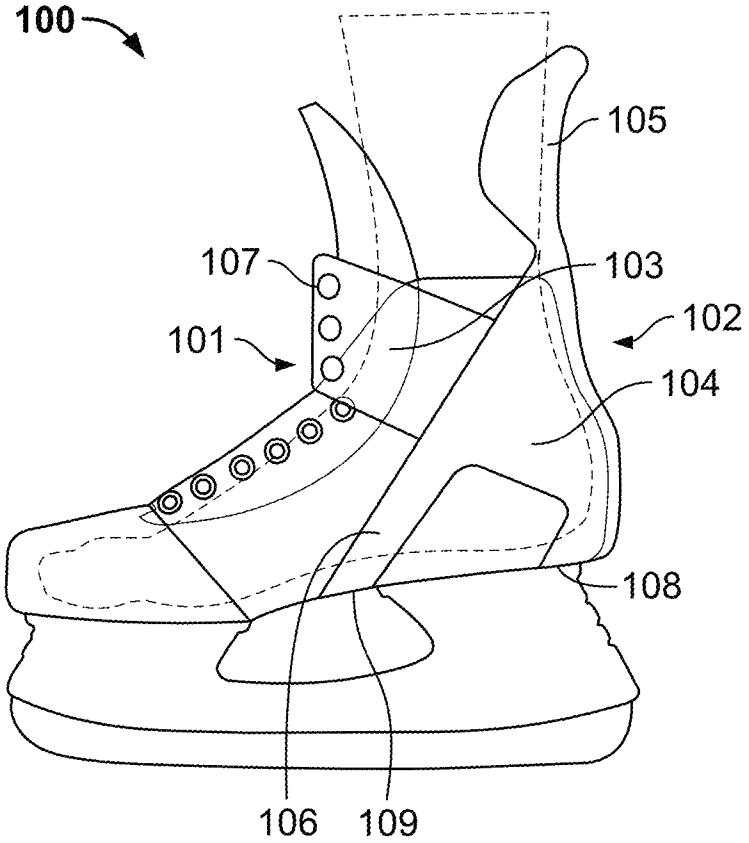
FIG. 10A shows a lateral side elevation view of an article of footwear having an elastomer cuff in a neutral or at-rest state or phase of motion, in accordance with some embodiments of the present invention.

Referring to FIGS. 10A and 10B, an embodiment of a modified article of footwear 100 has a tendon cuff/guard ("tendon guard cuff") 101. The modified article of footwear 100 includes a boot or shell portion, which can include features of the boot or shell portion 11 of FIGS. 1A and 1B modified by removal of a (e.g., first) portion of the reinforcement portion 17 proximate the user's instep, i.e., at the opening for inserting the user's foot, as well as a number (e.g., three) of the eyelets 18.

The tendon guard cuff 101 of the modified article of footwear 100 further includes a (e.g., thermoplastic composite, and the like) tendon guard 102 to which two tensile (e.g., elastomer) cuff portions 103 are (e.g., fixedly) attached. In some embodiments, the tendon guard cuff 101 may have unitary, monolithic construction, such that the tendon guard 102 and the tensile cuff portions 103 are combined as one structure to form the tendon guard cuff 101.

In some variations, the tendon guard cuff 101 may be constructed from two or more structures. As an example, the tendon guard cuff 101 can be formed from one material or two or more co-molded materials to form the unitary tendon guard cuff 101. The tensile cuff portion 103 may be manufactured from elastomer, foam, and/or plastic materials. In some implementations, the tendon guard 102 may include a central portion 104, an Achilles heel tendon portion 105, and a (e.g., center) strap portion 106, while the tensile cuff portion 103 may further include a number of eyelets 107 for receiving laces to lacings. The eyelets 107 may be provided along a periphery, e.g., edge, of each of the tensile cuff portions 103 adjacent to medial and lateral ankle portions of the boot or shell portion.

Preferably, the tendon guard 102 and tensile cuff portion 103 may be fixedly attached to the boot or shell portion of the article of footwear 100 at two locations 108, 109. The first location 108 may be proximate the heel portion of the article of footwear 100, for example, between the outsole of the article of footwear 100 and the skate blade holder 12. The second location 109 may be proximate a midfoot portion of the article of footwear 100, between the strap portion 106 and the skate blade holder 12. In other variations, the first location 108 may be proximate a bottom of the heel portion of the article of footwear 100, for example, on an exterior surface of the skate blade holder 12. In other variations, the second location 109 may be proximate a bottom of the heel portion of the article of footwear 100, for example, on an exterior surface of the skate blade holder 12. The tensile cuff portion 103 may be structured and arranged to primarily flex (e.g., via elastic deformation) in an anterior or forward direction corresponding to a longitudinal axis of the modified article of footwear 100. Elastic deformation of the tensile cuff portion 103 (e.g., by a user's body weight and/or dorsiflexion of the user's foot) may be referred to herein as a "loading phase" and a recovery of the tensile cuff portion 103 from an elastically deformed position to an original position (also referred to herein as a "neutral position") may be referred to herein as an "unloading phase". Potential energy may be stored by the tensile cuff portion 103 during the loading phase and the stored potential energy may be released by the tensile cuff portion 103 during the unloading phase.

Advantageously, as shown in FIG. 10B, the tensile cuff portion 103 facilitates progressive forward flexure and energy storage during a loading phase of a skating stride, where the loading phase of the skating stride includes dorsiflexion of a wearer's foot to a dorsiflexed position and provides an energy return that is based on the energy storage during an unloading phase of the skating stride, where the unloading phase of the skating stride includes recovery of the wearer's foot to a neutral position from the dorsiflexed position. For example, the tensile cuff portion 103 may be structured and arranged to provide progressive forward flexure of the modified article of footwear 100 and tendon guard 102 while providing and storing mechanical energy for returning the modified article of footwear 100 and tendon guard 102 to a neutral, at rest state (FIG. 10A). Mechanical energy is stored by the tensile cuff portion 103 during extension of the tensile cuff portion 103 and mechanical energy is returned during contraction of the tensile cuff portion 103.

Flexible Boot or Shell Portion with Reinforced, Removable Liner

Figure 11B:
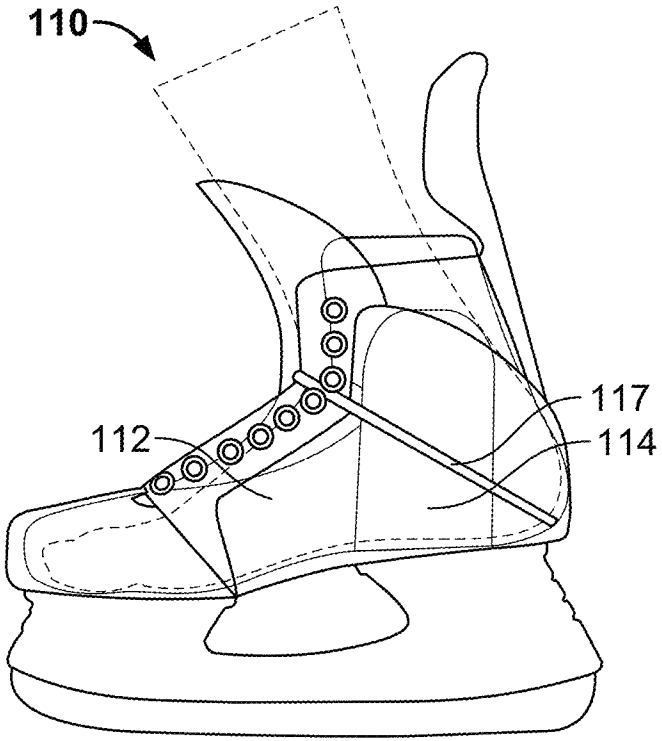
FIG. 11B shows a lateral side elevation view of the article of footwear of FIG. 11A in a compression phase of motion, in accordance with some embodiments of the present invention.
Figure 11A:
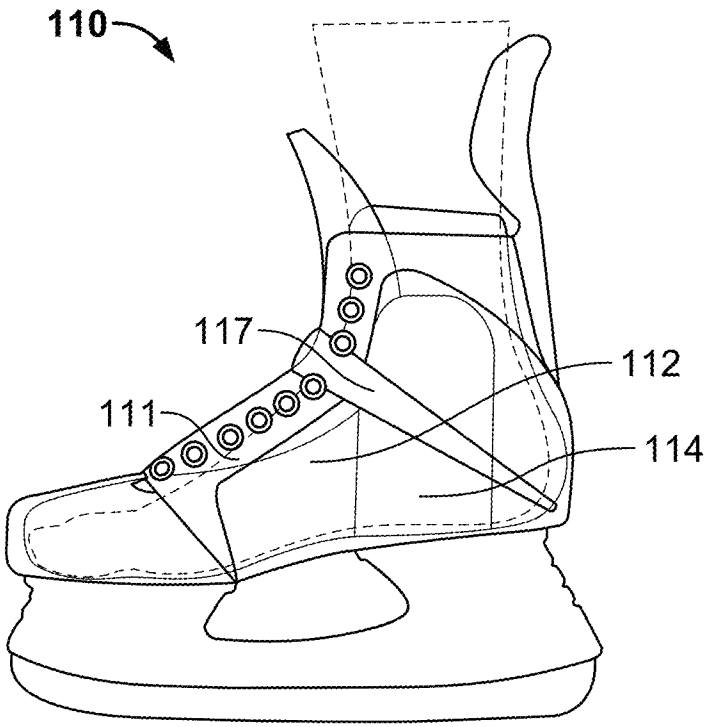
FIG. 11A shows a lateral side elevation view of an article of footwear having a reinforced removable liner in a neutral or at-rest state or phase of motion, in accordance with some embodiments of the present invention.

Referring to FIGS. 11A and 11B, an embodiment of a modified article of footwear 110 can include features of the hockey skate 10 of FIGS. 1A and 1B modified by addition of a removable and interchangeable (e.g., thermoformable foam, and the like) liner portion 112 about or to which a (e.g., thermoplastic composite and the like) plate reinforcement portion 114 may be wrapped or adhered proximate the arch of the skater's foot. Advantageously, the (e.g., thermoplastic composite and the like) plate reinforcement portion 114 provides lateral stiffness beneath a boot or shell portion 111 of the article of footwear 110. While the article of footwear 110 is shown and described as including a removeable and interchangeable liner portion 112, some embodiments of the article of footwear may include a built-in (e.g., thermoformable) foam/fabric liner that may be glued onto an inner surface of the boot or shell portion 111.

Further, as shown in FIGS. 11A and 11B with respect to the article of footwear 110, the hockey skate 10 of FIGS. 1A and 1B has been modified to include a compressible structure 117 in the boot or shell portion 111. The compressible structure 117 may be an integral portion of the boot or shell portion 111 in an ankle portion and/or a quarter/midfoot portion of the boot or shell portion 111. Alternatively, the compressible structure 117 may not be an integral portion of the boot or shell portion 111 and may be housed within, assembled into, and/or coupled to the sole portion (e.g., outsole) or heel portion of the boot or shell portion 111. The compressible structure 117 may be manufactured from a compressible material configured to reduce stiffness and modulus in a sagittal plane of a wearer of the modified article of footwear 110, e.g., along a longitudinal axis of the article of footwear. Examples of compressible materials may include such as foam (e.g., high-rebound, high-modulus foam), elastomer (e.g., thermoplastic, rubber, polyether block amide, etc.), and variable composite materials (e.g., varying in relative to a composite material of the boot or shell portion 111). A variable composite material included in the compressible structure 117 may be a composite material that removes material(s), includes additional material(s), and/or includes variable resin properties relative to a composite material of the boot or shell portion 111.

The compressible structure 117 may be an accordion structure including corrugated, folded, and/or fluted geometry (e.g., including two or more folds or corrugations) configured to reduce stiffness and modulus in a sagittal plane of a wearer of the modified article of footwear 110. The compressible structure 117 may be a portion of the boot or shell portion 111 having a reduced thickness relative to another portion of the boot or shell portion 111, where the compressible structure 117 is configured to reduce stiffness and modulus in a sagittal plane of a wearer of the modified article of footwear 110. Deformation (e.g., elastic deformation) of the compressible structure 117 (e.g., by a user's body weight and/or dorsiflexion of the user's foot) may be referred to herein as a "loading phase" and a recovery of the compressible structure 117 from an elastically deformed position to an original position (also referred to herein as a "neutral position") may be referred to herein as an "unloading phase". Potential energy may be stored by the compressible structure 117 during the loading phase and the stored potential energy may be released by the compressible structure 117 during the unloading phase.

Advantageously, the compressible structure 117 of the modified article of footwear 110 facilitates progressive forward flexure and energy storage during a loading phase of a skating stride, where the loading phase of the skating stride includes dorsiflexion of a wearer's foot to a dorsiflexed position and provides an energy return that is based on the energy storage during an unloading phase of the skating stride, where the unloading phase of the skating stride includes or recovery of the wearer's foot to a neutral position from the dorsiflexed position. For example, the compressible structure 117 may be structured and arranged to provide progressive forward flexure (FIG. 11B) along a longitudinal axis of the modified article of footwear 110 (e.g., via volume reduction or deformation) while providing and storing mechanically energy for returning the article of footwear 110 to a neutral or at-rest state (FIG. 11A). In particular, the compressible structure 117 may allow flexion or compression in one direction but remain stiff in another direction. In some variations, a compressible structure 117 may be (e.g., symmetrically or asymmetrically) included on each of opposing (e.g., medial and lateral) ankle portions and/or quarter/midfoot portions of the boot or shell portion 111 between a heel portion and forefoot portions of the boot or shell portion 111. In an embodiment, compressible structures 117 may be disposed along the ankle, between more rigid forefoot and ankle areas. This enables a hinging behavior of the compressible structures 117 in which the compressible structures 117 crumples when a skater leans forward, with support being maintained side to side.

Boot or Shell Portion and Cuff/Tendon Guard with Compressible Structure

Figure 12B:
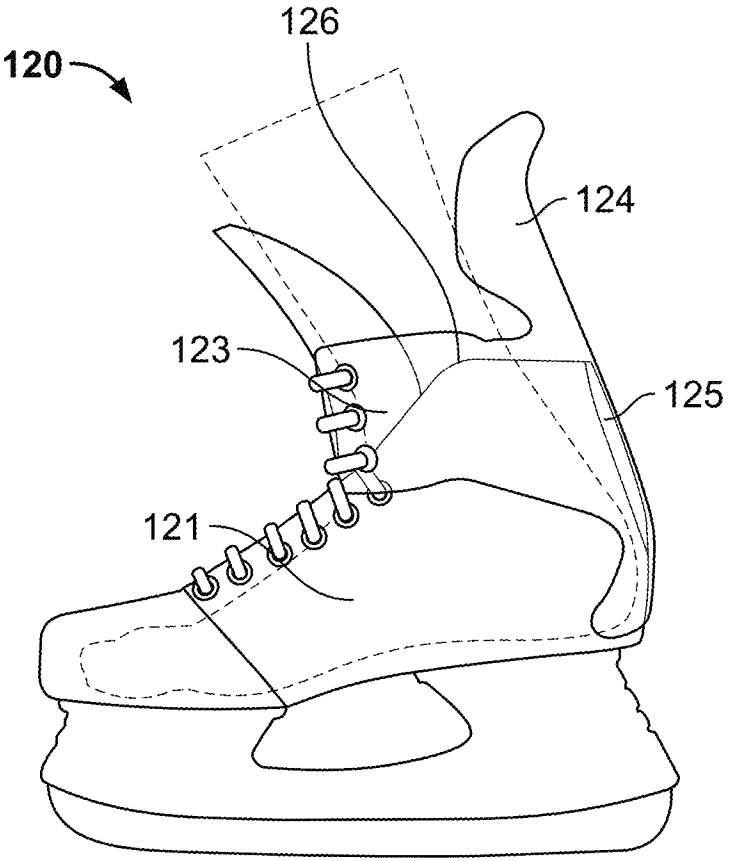
FIG. 12B shows a lateral side elevation view of the article of footwear of FIG. 12A in a compression phase of motion, in accordance with some embodiments of the present invention.
Figure 12A:
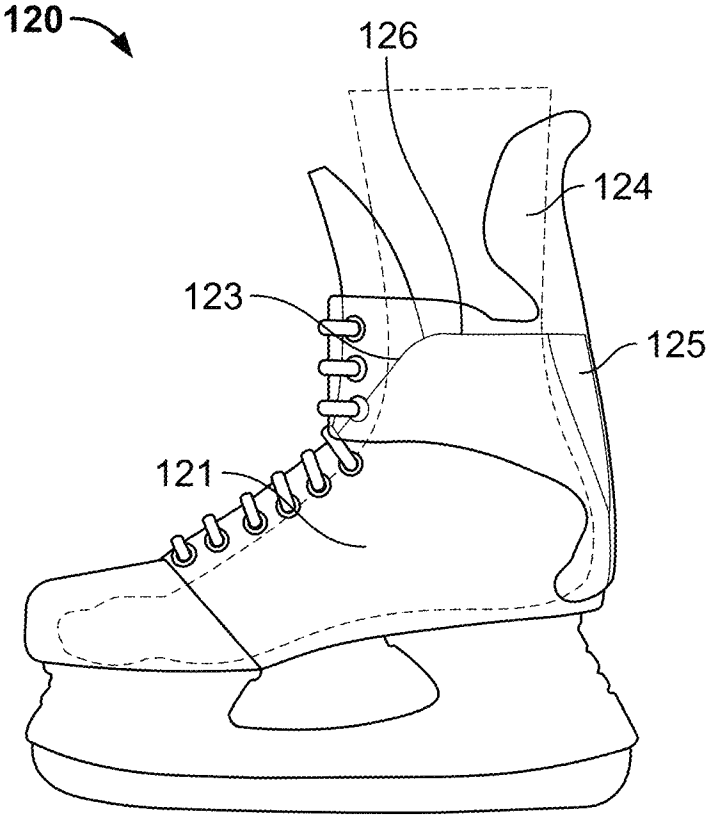
FIG. 12A shows a lateral side elevation view of an article of footwear having a compressible structure in a neutral or at-rest state or phase of motion, in accordance with some embodiments of the present invention.

Referring to FIGS. 12A and 12B, another embodiment of a modified article of footwear 120 may include a boot or shell portion 121 and a tendon cuff/guard ("tendon guard cuff") including a main (e.g., cuff) portion 123 and an Achilles heel tendon portion 124. In some embodiments, as discussed above with respect to FIGS. 3A and 3B, the tendon guard cuff may have unitary, monolithic construction, such that the cuff portion 123 and the Achilles heel tendon portion 124 are combined as one structure to form the tendon guard cuff portion. In some variations, the tendon guard cuff may be constructed from two or more structures. As shown in FIGS. 12A and 12B, the hockey skate 10 of FIGS. 1A and 1B has been modified to include a compressible structure 125 proximate the user's Achilles heel and back ankle region in the heel portion of the article of footwear 120. The compressible structure can be disposed between an outer surface of the boot or shell portion 121 of the article of footwear 120 and an inner surface of the cuff portion 123 and Achilles heel tendon portion 124. Advantageously, the compressible structure 125 may be manufactured from a material that can elastically deform (e.g., compress) and recover to an initial position (e.g., uncompressed or minimally compressed position), with the material providing an energy return when recovering to the initial position after elastic deformation. The compressible structure 125 may preferably be manufactured from a foam (e.g., high-rebound foam) or elastomeric material.

The compressible structure 125 may be coupled (e.g., via adhesive or fastener(s)) to a heel portion of the outer surface of the boot or shell portion 121 of the article of footwear 120 and/or to an inner surface of a unitary, cuff portion 123 and Achilles heel tendon portion 124. Optionally, the compressible structure 125 may be removably attached to the boot or shell portion 121 and/or the cuff portion 123 and Achilles heel tendon portion 124. Advantageously, the compressible structure 125 may be interchangeable (e.g., modular) to provide a desired level of stiffness. Although FIGS. 12A and 12B show a compressible structure 125 that extends to the top of an ankle portion 126 of the boot or shell portion 121, those of ordinary skill in the art can appreciate that the compressible structure 125 may also extend below or above the height of the ankle portion 126 of the boot or shell portion 121.

The compressible structure 125 may protrude upward or substantially upward, perpendicular or substantially perpendicular to the outsole and/or in the same axis as the skater's leg. When connected to the leg via strapping or other material, the compressible structure 125 is adapted to resist dorsiflexion of the leg. Advantageously, the compressible structure 125 has a relative stiffness high enough to support the user's body weight through dorsiflexion, thereby behaving like a spring such that any elastic compression of the compressible structure 125 that occurs generates potential energy, which will be released when pressure is reduced or removed. Deformation (e.g., elastic deformation) of the compressible structure 125 (e.g., by a user's body weight and/or dorsiflexion of the user's foot) may be referred to herein as a "loading phase" and a recovery of the compressible structure 125 from an elastically deformed position to an original position (also referred to herein as a "neutral position") may be referred to herein as an "unloading phase". Potential energy may be stored by the compressible structure 125 during the loading phase and the stored potential energy may be released by the compressible structure 125 during the unloading phase. Indeed, in some implementations, the compressible structure 125 may be structured and arranged to provide progressive flexure and energy storage during a loading phase of a skating stride, where the loading phase of the skating stride includes dorsiflexion of a wearer's foot to a dorsiflexed position and provide an energy return that is based on (e.g., positively correlated with) the energy storage during an unloading phase of the skating stride, where the unloading phase of the skating stride includes recovery of the wearer's foot to a neutral position from the dorsiflexed position. For example, the compressible structure 125 may be structured and arranged to provide progressive flexure of the article of footwear 120 in an anterior or forward direction of skating and provide an energy return in a posterior direction substantially opposite to the forward direction of skating. The stiffness of the compressible structure 125 is preferably be configured such that a user's mass is fully supported by the compressible structure 125 at the peak of dorsiflexion. The compressible structure 125 can reach the peak of dorsiflexion without muscular activation by the user as energy expenditure in this range of motion is inefficient with respect to the direction of motion.

Advantageously, the cuff portion 123 and Achilles heel tendon portion 124 remain in position relative to the user's foot throughout the range of motion. More particularly, as shown in FIG. 12A and FIG. 12B, corresponding to an at-rest, standing, or neutral state and to an anterior dorsiflexion or compression state, respectively, the compressible structure 125 facilitates progressive forward flexure (FIG. 12B) in the cuff portion 123 while providing energy for returning the compressible structure 125 to an at rest state (FIG. 12A). More specifically, during the compression phase of a skater's stride, the skater dorsiflexes the cuff portion 123 and Achilles heel tendon portion 124, causing the compressible structure 125 to compress in an anterior direction, loading the compressible structure 125 with energy. When the skater enters an extension phase of their stride, the stored mechanical energy in the compressible structure 125 is returned to the skater, providing a mechanical assist to the stride. Advantageously, the Achilles heel tendon portion 124 remains close to the skater's Achilles heel tendon throughout the range of motion.

Boot or Shell Portion with Cuff/Tendon Guard

Figure 13B:
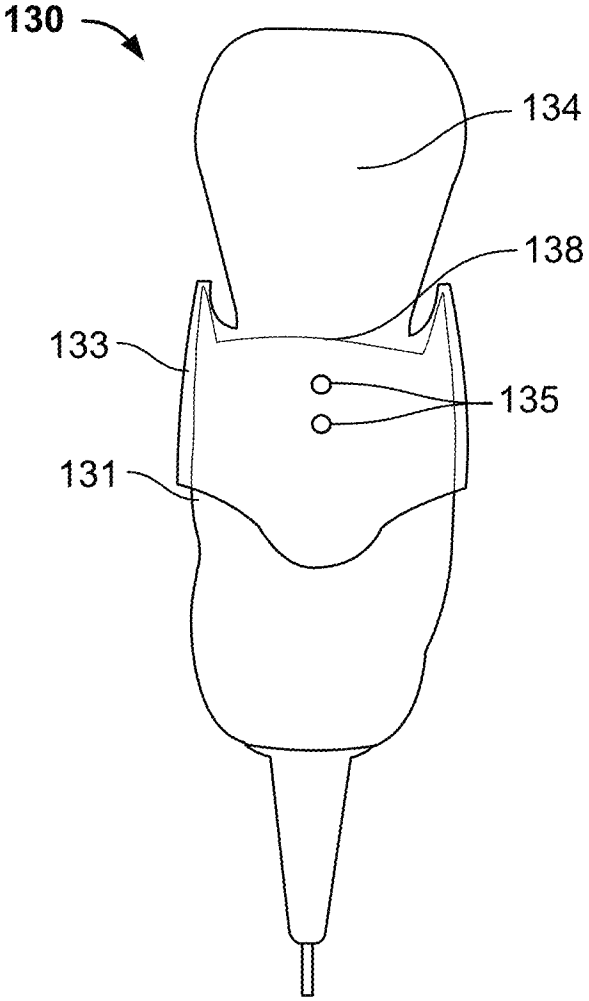
FIG. 13B shows a rear elevation view of the article of footwear of FIG. 13A, in accordance with some embodiments of the present invention.
Figure 13A:
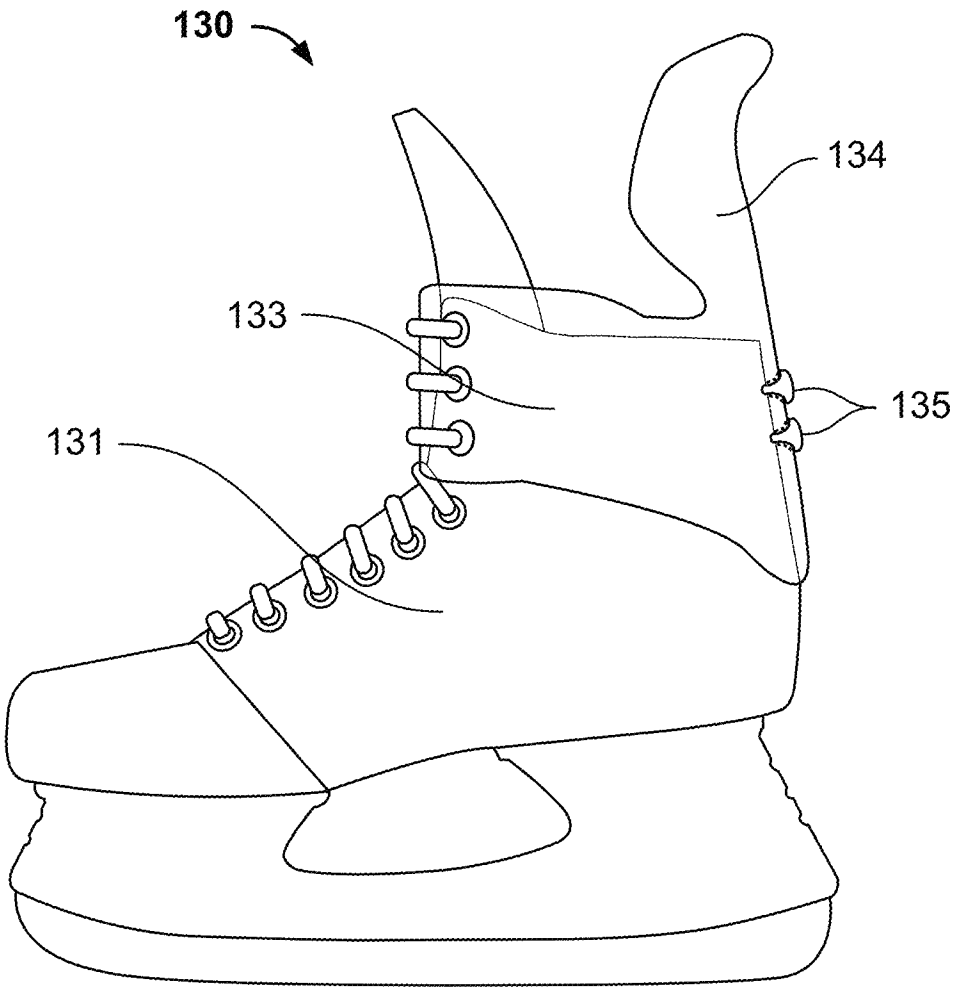
FIG. 13A shows a lateral side elevation view of an article of footwear having a cuff/tendon guard, in accordance with some embodiments of the present invention.

Referring to FIGS. 13A-13B, another embodiment of a modified article of footwear 130 includes the boot or shell portion 131, which can include features of the boot or shell portion 11 of FIGS. 1A and 1B modified by addition of one or more physical connection points 135. In some applications, the modified article of footwear 130 further includes a cuff/tendon guard ("tendon guard cuff") including a main (e.g., cuff) portion 133, an Achilles heel tendon portion 134, and a number of eyelets. A number of fastening or connection devices (e.g., rivets, threaded fasteners, stitches, and the like) may be used to fixedly attach the tendon guard cuff to the boot or shell portion 131 at one or more physical connection points 135. In some variations, the fastening or connection devices may extend through the boot or shell portion 131 and/or the tendon guard cuff. In some variations, the physical connection points 135 on the boot or shell portion 131 at which the tendon guard cuff is connected may be located proximate the user's Achilles heel and back ankle region 138 in the heel portion of the article of footwear 130. In some variations, the physical connection points 135 on the boot or shell portion 131 at which the tendon guard cuff is connected may be located on a heel portion, a medial ankle portion, and/or a lateral ankle portion of the boot or shell portion 131. As an example, the tendon guard cuff may be attached at physical connection points 135 on an upper heel portion and/or a lower Achilles heel portion of the heel portion of the boot or shell portion 131. In some variations, the physical connection points 135 on the boot or shell portion 131 at which the tendon guard cuff is connected may be located on a periphery, e.g., edge, of the boot or shell portion 131. The position(s) of the physical connection points 135 may be selected based on a desired flexibility (e.g., stiffness) of the tendon guard cuff. As an example, a physical connection point 135 positioned lower (e.g., toward the sole portion of the modified article of footwear 130) on a heel portion of the boot or shell portion 131 may increase the stiffness at which the tendon guard cuff flexes during dorsiflexion of the modified article of footwear 130, while a physical connection point 135 positioned higher (e.g., away from the sole portion of the modified article of footwear 130) on the heel portion of the boot or shell portion 131 may reduce the stiffness at which the tendon guard cuff flexes during dorsiflexion of the modified article of footwear 130. One or both of the physical connection points 135 can couple the tendon guard cuff, e.g., the Achilles heel tendon portion 134, to the boot or shell portion 131.

Advantageously, the cuff portion 133 and Achilles heel tendon portion 134 are structured and arranged to pivot about an axis of a skater's ankle based on the physical connection points 135. In some variations, the cuff portion 133 and Achilles heel tendon portion 134 may be configured to bend, deflect, and/or flexibly deform relative to an axis of a skater's foot or ankle. Dorsiflexion of a skater's foot may cause localized or distributed deflection (e.g., relative to a skater's foot or ankle) of the cuff portion 133 and Achilles heel tendon portion 134 about an area proximate (e.g., above) the physical connection points 135.

In some applications, based on relative positioning of the eyelets of the cuff portion 133 of the tendon guard cuff and the eyelets of the boot or shell portion 131, a lacing can removably couple the cuff portion 133 of the tendon guard cuff to the boot or shell portion 131 via shared engagement with the lacing by at least one eyelet of the cuff portion 133 and at least one eyelet of the boot or shell portion 131. A lacing can be threaded through each of a first eyelet of the cuff portion 133 and a second eyelet of the boot or shell portion 131, with the first and second eyelets being adjacent to each other. By threading of a lacing through adjacent (e.g., pairs of) eyelets of the cuff portion 133 and boot or shell portion 131, the tendon guard cuff can be removably coupled to the boot or shell portion 131. In the example illustrated in FIGS. 13A and 13B, the three eyelets of the cuff portion 133 may be adjacent to the three eyelets of the boot or shell portion 131 proximate the user's instep, i.e., at the opening for inserting the skater's foot, such that a lacing is threaded through adjacent eyelets of the cuff portion 133 and boot or shell portion 131 and removably couples the cuff portion 133 and the boot or shell portion 131.

Advantageously, in some embodiments, a configuration of the tendon guard cuff and coupling of the tendon guard cuff to the boot or shell portion 131 can provide increased flexibility to the article of footwear 130. When connected to the leg via strapping or other material, the cuff portion 133 and/or the Achilles heel tendon portion 134 of the tendon guard cuff can be adapted to resist dorsiflexion of the leg. Advantageously, the cuff portion 133 and/or the Achilles heel tendon portion 134 may be configured to have a relative stiffness high enough to support the user's body weight through dorsiflexion, imparting a bend and behaving like a spring such that any elastic deformation of the cuff portion 133 and/or the Achilles heel tendon portion 134 that occurs generates potential energy, which will be released when pressure is reduced or removed and the cuff portion 133 and/or the Achilles heel tendon portion 134 recover to an original, neutral position and/or shape. Elastic deformation of the cuff portion 133 and/or the Achilles heel tendon portion 134 (e.g., by a user's body weight and/or dorsiflexion of the user's foot) may be referred to herein as a "loading phase" and a recovery of the cuff portion 133 and/or the Achilles heel tendon portion 134 from an elastically deformed position to an original position (also referred to herein as a "neutral position") may be referred to herein as an "unloading phase". Potential energy may be stored by the tendon guard cuff during the loading phase and the stored potential energy may be released by the tendon guard cuff during the unloading phase. Indeed, in some implementations, the tendon guard cuff may be structured and arranged to provide progressive flexure and energy storage during a loading phase of a skating stride, where the loading phase of the skating stride includes dorsiflexion of a wearer's foot to a dorsiflexed position and provide an energy return that is based on (e.g., positively correlated with) the energy storage during an unloading phase of the skating stride, where the unloading phase of the skating stride includes recovery of the wearer's foot to a neutral position from the dorsiflexed position. For example, the cuff portion 133 of the tendon guard cuff may be structured and arranged to provide progressive flexure of the article of footwear 130 in an anterior or forward direction of skating and provide an energy return in a posterior direction substantially opposite to the forward direction of skating.

In some embodiments, the stiffness of the tendon guard cuff may preferably be configured such that a user's mass is fully supported by the tendon guard cuff at the peak of dorsiflexion. In an embodiment, the tendon guard cuff may flex 5°-50° (e.g., preferably flex 10°-30°) in an anterior or forward direction of skating relative to a vertical axis (e.g., axis of a skater's leg or axis perpendicular to an outsole of the article of footwear 130). The tendon guard cuff may primarily flex (e.g., deflect) in an anterior or forward direction corresponding to a longitudinal axis of the article of footwear 130. In some variations, the tendon guard cuff may deflect in a medial or lateral direction during flexure (e.g., deflection) of the tendon guard cuff in an anterior or forward direction. A thickness of the tendon guard cuff may be uniform or variable over the length of the tendon guard cuff, thereby providing uniform or variable stiffness of the tendon guard cuff. The tendon guard cuff can reach the peak of dorsiflexion without muscular activation by the user as energy expenditure in this range of motion is inefficient with respect to the direction of motion.

In some embodiments, the modified article of footwear 130 can include one or more slots (not shown) in the boot or shell portion 131 in place of or in addition to the eyelets of the boot or shell portion 131. Based on relative positioning of the eyelets of the cuff portion 133 of the tendon guard cuff and the slots of the boot or shell portion 131, a lacing can removably couple the cuff portion 133 of the tendon guard cuff to the boot or shell portion 131 via shared engagement with the lacing by at least one eyelet of the cuff portion 133 and at least one slot of the boot or shell portion 131. A lacing can be threaded through each of an eyelet of the cuff portion 133 and a slot of the boot or shell portion 131, with the eyelet and slot being adjacent to each other. By threading of a lacing through an adjacent eyelet and slot of the cuff portion 133 and boot or shell portion 131, respectively, the tendon guard cuff can be removably coupled to the boot or shell portion 131.

Figure 14B:
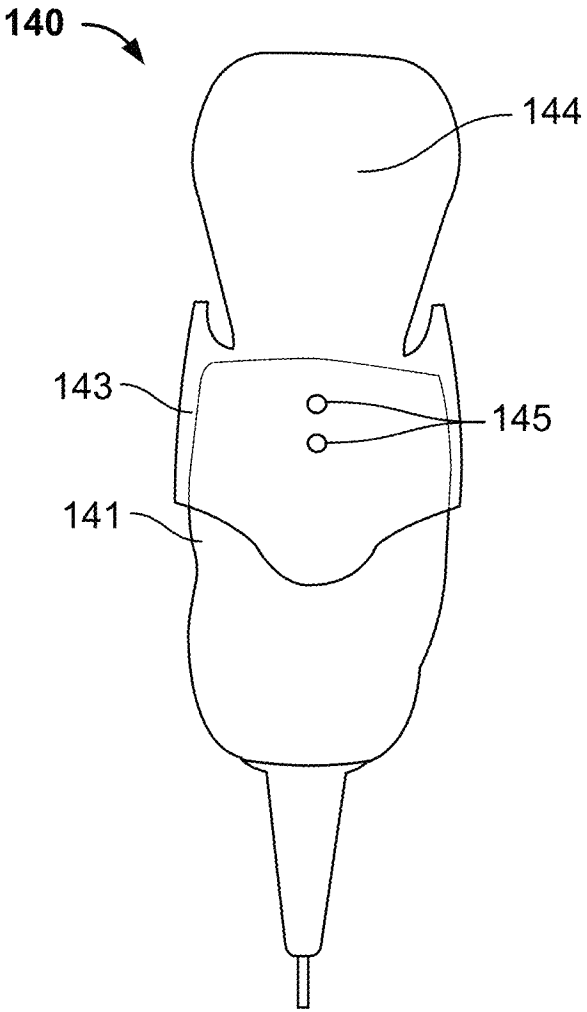
FIG. 14B shows a rear elevation view of the article of footwear of FIG. 14A, in accordance with some embodiments of the present invention.
Figure 14A:
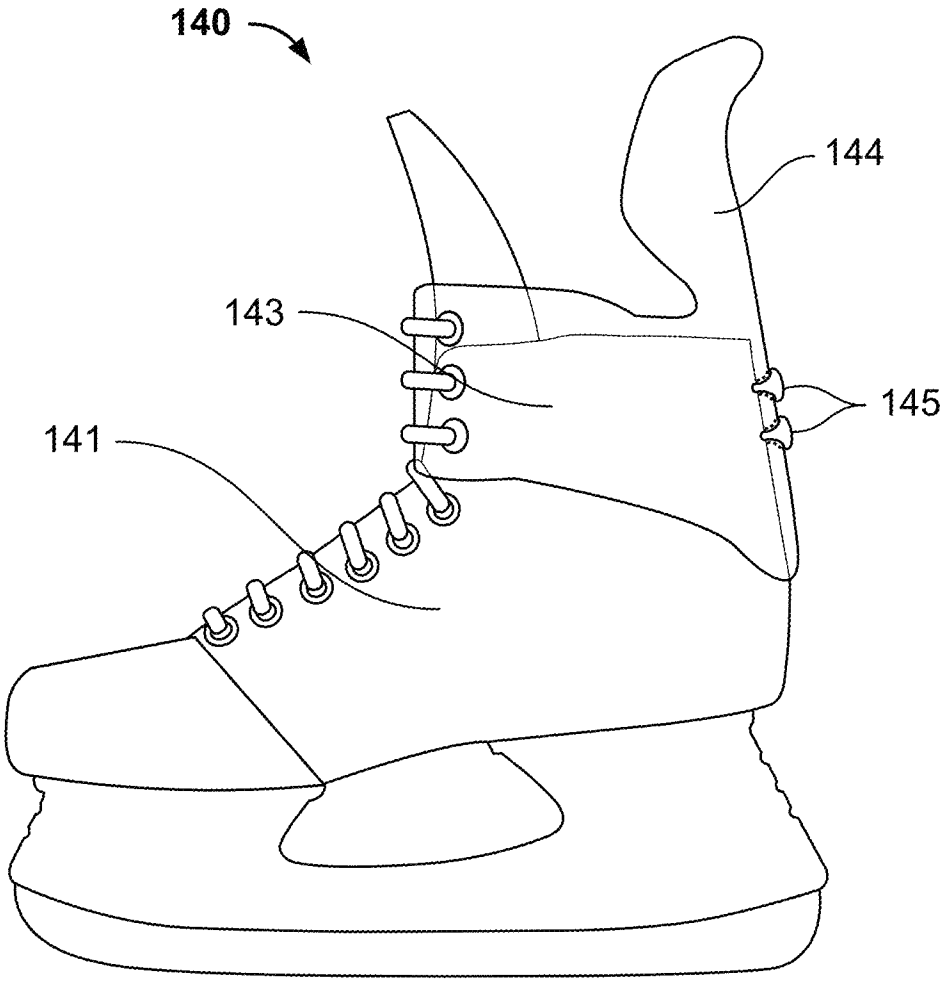
FIG. 14A shows a lateral side elevation view of an article of footwear having a cuff/tendon guard, in accordance with some embodiments of the present invention.

Referring to FIGS. 14A-14B, another embodiment of a modified article of footwear 140 includes the boot or shell portion 141, which can include features of the boot or shell portion 11 of FIGS. 1A and 1B modified by removal of a (e.g., first) portion of the reinforcement portion proximate the user's instep, i.e., at the opening for inserting the skater's foot proximate the medial and lateral ankle portions of the boot or shell portion 11, and a number (e.g., one) of the eyelets 18 from each reinforcement portion 17 and addition of one or more physical connection points 145. In some applications, the modified article of footwear 140 further includes a cuff/tendon guard ("tendon guard cuff") including a main (e.g., cuff) portion 143, an Achilles heel tendon portion 144, and a number of eyelets. A number of fastening or connection devices (e.g., rivets, threaded fasteners, stitches, and the like) may be used to fixedly attach the tendon guard cuff to the boot or shell portion 141 at the one or more physical connection points 145. In the example illustrated in FIGS. 14A and 14B, the two bottom pairs of eyelets of the cuff portion 143 may be adjacent to the two pairs of eyelets of the boot or shell portion 141 proximate the user's instep, i.e., at the opening for inserting the skater's foot, such that a lacing is threaded through adjacent eyelets of the cuff portion 143 and boot or shell portion 141 and removably couples the cuff portion 143 and the boot or shell portion 141.

Figure 15B:
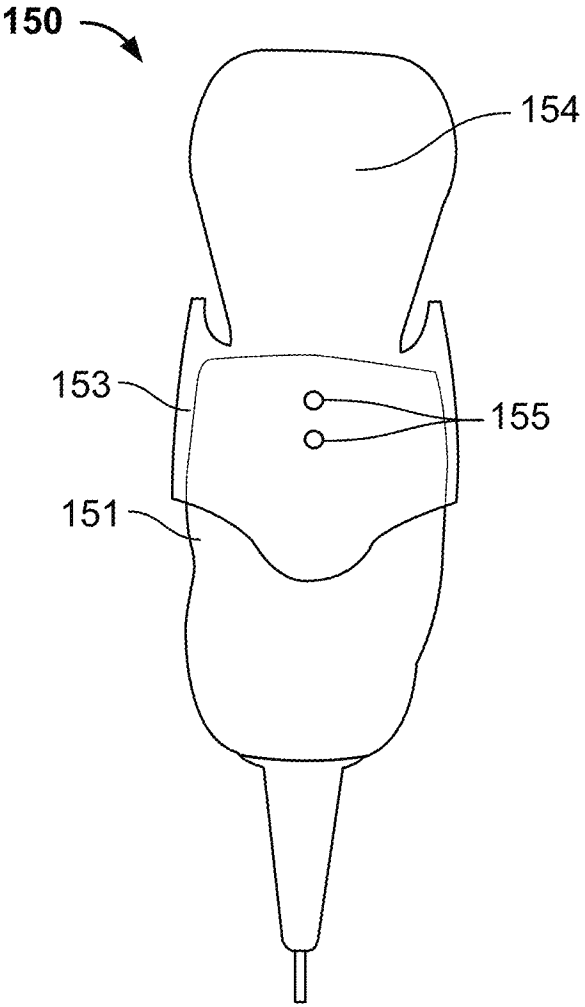
FIG. 15B shows a rear elevation view of the article of footwear of FIG. 15A, in accordance with some embodiments of the present invention.
Figure 15A:
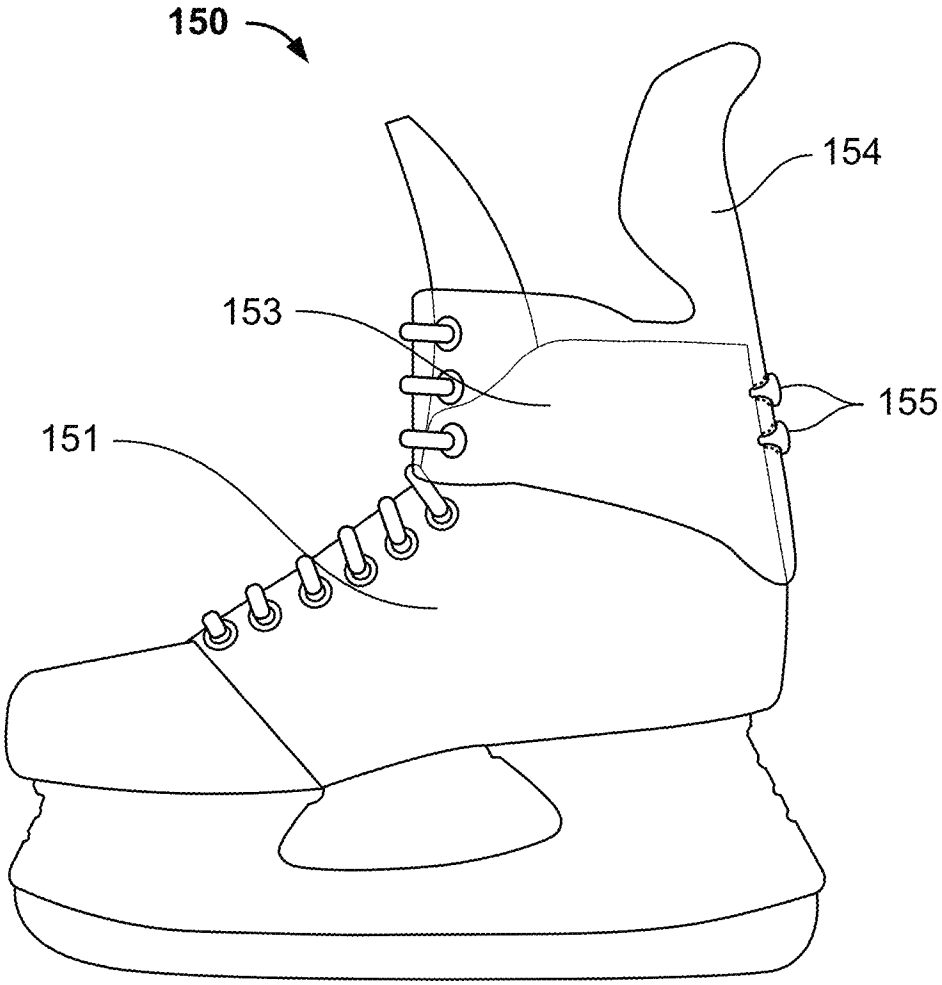
FIG. 15A shows a lateral side elevation view of an article of footwear having a cuff/tendon guard, in accordance with some embodiments of the present invention.

Referring to FIGS. 15A-15B, another embodiment of a modified article of footwear 150 includes the boot or shell portion 151 that includes features of the boot or shell portion 11 of FIGS. 1A and 1B modified by removal of a (e.g., first) portion of the reinforcement portion proximate the user's instep, i.e., at the opening for inserting the skater's foot proximate the medial and lateral ankle portions of the boot or shell portion 11, and a number (e.g., two) of the eyelets 18 from each reinforcement portion 17 and addition of one or more physical connection points 155. In some applications, the modified article of footwear 150 further includes a cuff/tendon guard ("tendon guard cuff") including a main (e.g., cuff) portion 153, an Achilles heel tendon portion 154, and a number of eyelets. A number of fastening or connection devices (e.g., rivets, threaded fasteners, stitches, and the like) may be used to fixedly attach the tendon guard cuff to the boot or shell portion 151 at the one or more physical connection points 155. In the example illustrated in FIGS. 15A and 15B, the one bottom pair of eyelets of the cuff portion 153 may be adjacent to the one bottom pair of eyelets of the boot or shell portion 151 proximate the user's instep, i.e., at the opening for inserting the skater's foot, such that a lacing is threaded through adjacent eyelets of the cuff portion 153 and boot or shell portion 151 and removably couples the cuff portion 153 and the boot or shell portion 151.

Figure 16B:
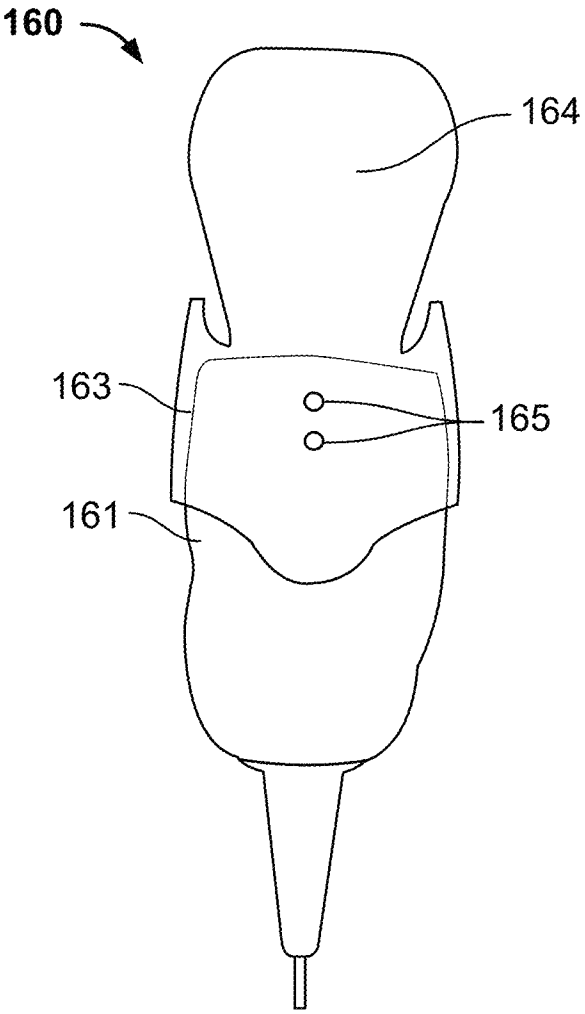
FIG. 16B shows a rear elevation view of the article of footwear of FIG. 16A, in accordance with some embodiments of the present invention.
Figure 16A:
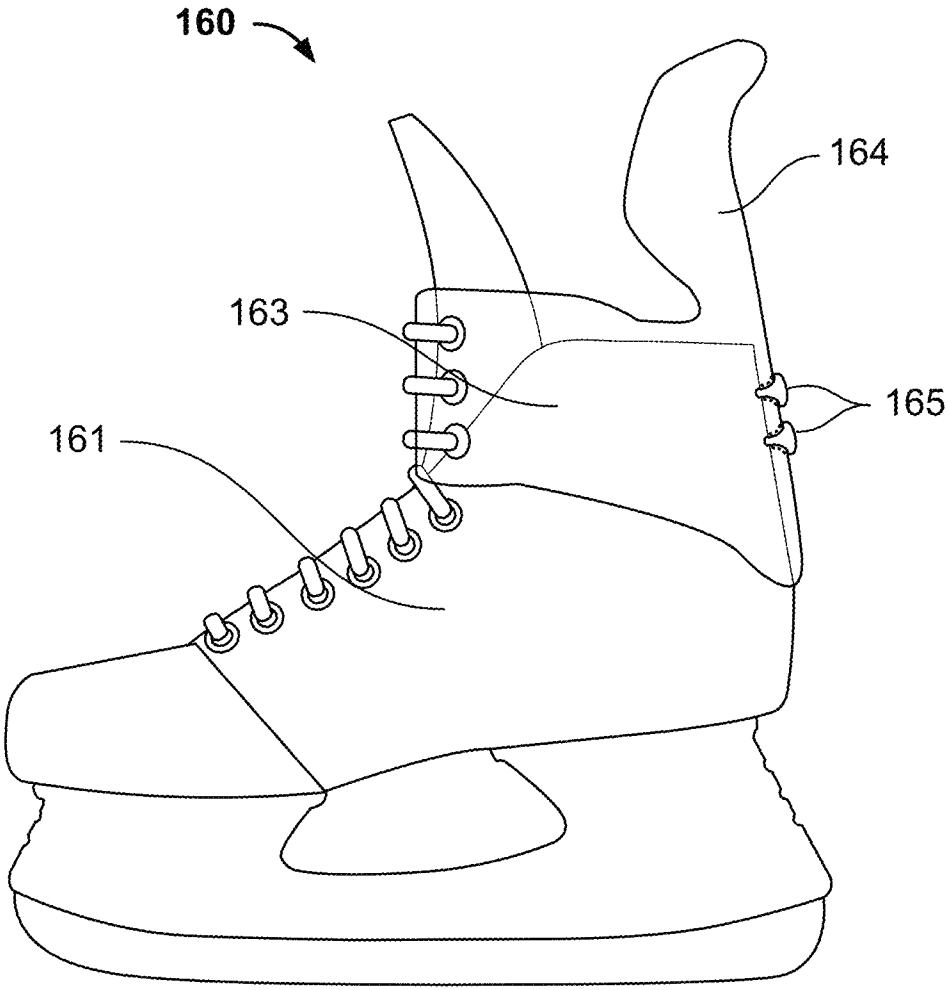
FIG. 16A shows a lateral side elevation view of an article of footwear having a cuff/tendon guard, in accordance with some embodiments of the present invention.

Referring to FIGS. 16A-16B, another embodiment of a modified article of footwear 160 includes the boot or shell portion 161 that includes features of the boot or shell portion 11 of FIGS. 1A and 1B modified by removal of a (e.g., first) portion of the reinforcement portion proximate the user's instep, i.e., at the opening for inserting the skater's foot proximate the medial and lateral ankle portions of the boot or shell portion 11, and a number (e.g., three) of the eyelets 18 from each reinforcement portion 17 and addition of one or more physical connection points 165. In some applications, the modified article of footwear 160 further includes a cuff/tendon guard ("tendon guard cuff") including a main (e.g., cuff) portion 163, an Achilles heel tendon portion 164, and a number of eyelets. A number of fastening or connection devices (e.g., rivets, threaded fasteners, stitches, and the like) may be used to fixedly attach the tendon guard cuff to the boot or shell portion 161 at the one or more physical connection points 165. In the example illustrated in FIGS. 16A and 16B, the boot or shell portion 161 may be connected to the tendon guard cuff, e.g., only, at the physical connection points 165.

In some embodiments, elastic deformation of the tendon guard cuff, e.g., the cuff portion 133, and energy storage during a loading phase of a skating stride may increase as a tendon guard cuff is increasingly decoupled from a boot or shell portion along a cuff portion of the tendon guard cuff. In some variations, elastic deformation of the tendon guard cuff, e.g., the cuff portion 133, and energy storage during a loading phase of a skating stride may increase as a number of eyelets are removed from the boot or shell portion 11 and a number of adjacent eyelets of the cuff portion and boot or shell portion through which is lacing is threaded is reduced. In the examples illustrated in FIGS. 13A and 16A, the tendon guard cuff including the cuff portion 163 may have increased elastic deformation and energy storage during a loading phase of a skating stride relative to the tendon guard cuff including the cuff portion 133.

Figure 17B:
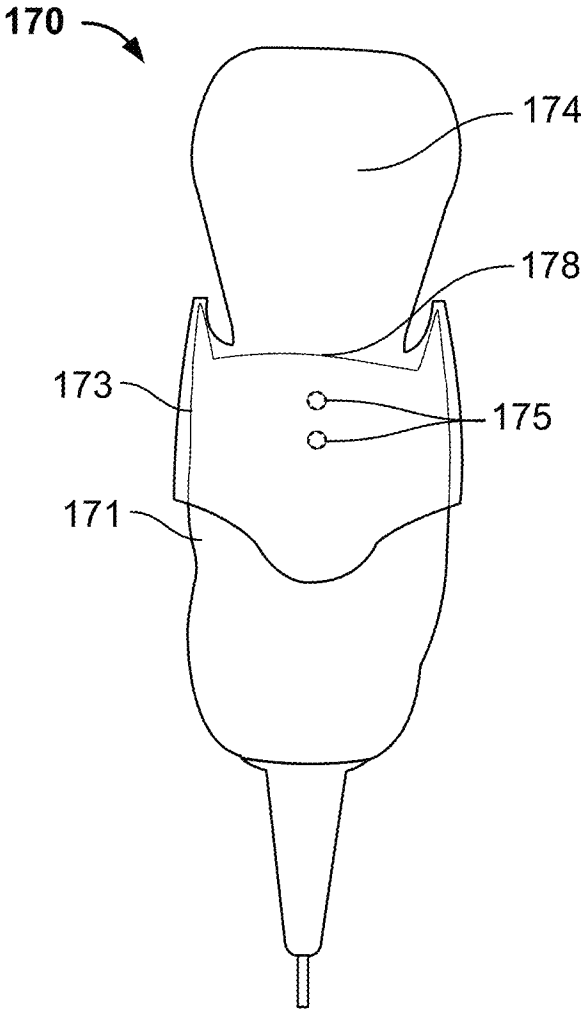
FIG. 17B shows a rear elevation view of the article of footwear of FIG. 17A, in accordance with some embodiments of the present invention.
Figure 17A:
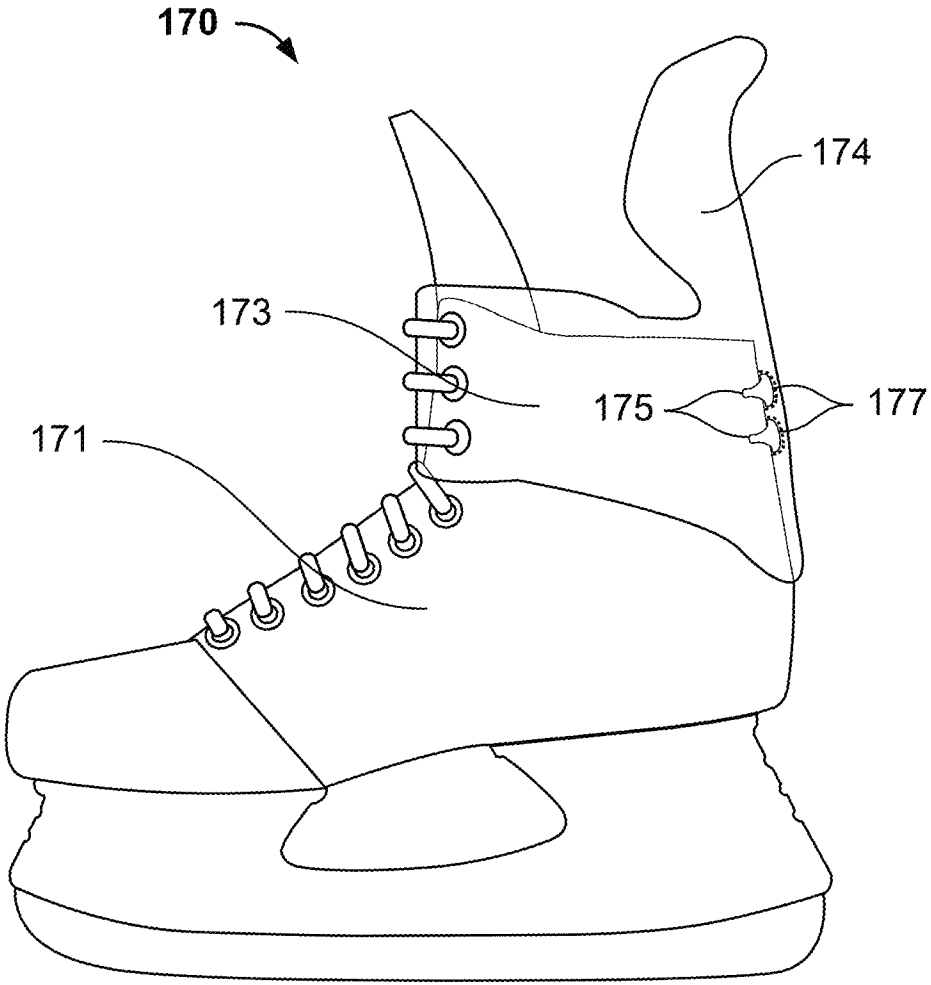
FIG. 17A shows a lateral side elevation view of an article of footwear having a cuff/tendon guard, in accordance with some embodiments of the present invention.

Referring to FIGS. 17A-17B, another embodiment of a modified article of footwear 170 includes the boot or shell portion 171, which can include features of the boot or shell portion 11 of FIGS. 1A and 1B modified by addition of one or more engagement structures 175. In some applications, the modified article of footwear 170 further includes a cuff/tendon guard ("tendon guard cuff") including a main (e.g., cuff) portion 173, an Achilles heel tendon portion 174, and a number of eyelets. The engagement structures 175 (e.g., protrusions, ridges, extensions, and the like) on the boot or shell portion 171 may engage with the tendon guard cuff and be used to removably attach the tendon guard cuff to the boot or shell portion 171 at the engagement structures 175. In some variations, the engagement structures 175 on the boot or shell portion 171 by which the tendon guard cuff removably couples to the boot or shell portion 171 may be located proximate the user's Achilles heel and back ankle region 178 in the heel portion of the article of footwear 170. In the example illustrated in FIG. 17A, the tendon guard cuff may engage with engagement structures 175, e.g., protrusions, extending outward from an upper heel portion and/or a lower Achilles heel portion of the heel portion of the boot or shell portion 171 towards the Achilles heel tendon portion 174 of the tendon guard cuff. In some variations, the tendon guard cuff may define one or more complementary structures 177 configured to receive and engage with the engagement structures 175. In the example illustrated in FIG. 17A, the complementary structures 177, e.g., indentations, may receive the engagement structures 175.

In some embodiments, the engagement structures 175 may be positioned between the boot or shell portion 171 and the tendon guard cuff. The position(s) of the engagement structures 175 on the boot or shell portion 171 may be selected based on a desired flexibility (e.g., stiffness) the tendon guard cuff. As an example, an engagement structure 175 positioned lower (e.g., toward the sole portion of the modified article of footwear) on a heel portion of the boot or shell portion 171 may increase the stiffness at which the tendon guard cuff flexes during dorsiflexion of the modified article of footwear 170, while an engagement structure 175 positioned higher (e.g., away from the sole portion of the modified article of footwear) on the heel portion of the boot or shell portion 171 may reduce the stiffness at which the tendon guard cuff flexes during dorsiflexion of the modified article of footwear 170. In some variations, engagement (e.g., contact) between the engagement structures 175 and the tendon guard cuff can constrain vertical translation and/or rotation of the tendon guard cuff about the eyelets by which the tendon guard cuff is coupled to the boot or shell portion 171 (if applicable). In the example illustrated in FIGS. 17A and 17B, the three pairs of eyelets of the cuff portion 173 may be adjacent to the three pairs of eyelets of the boot or shell portion 171 proximate the user's instep, i.e., at the opening for inserting the skater's foot, to removably couple the cuff portion 173 and the boot or shell portion 171 via a lacing, with the engagement structures 175 and the tendon guard cuff constraining vertical translation and/or rotation of the tendon guard cuff about the adjacent pairs of eyelets.

Figure 18B:
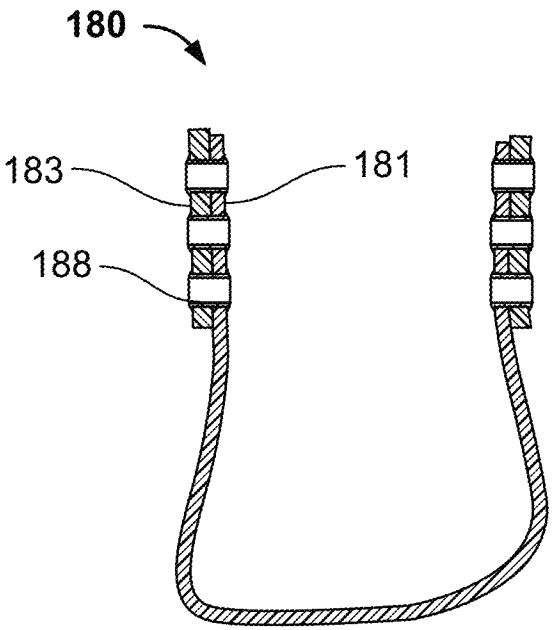
FIG. 18B shows a cross-sectional view taken along lines A-A of FIG. 18A, in accordance with some embodiments of the present invention.
Figure 18A:
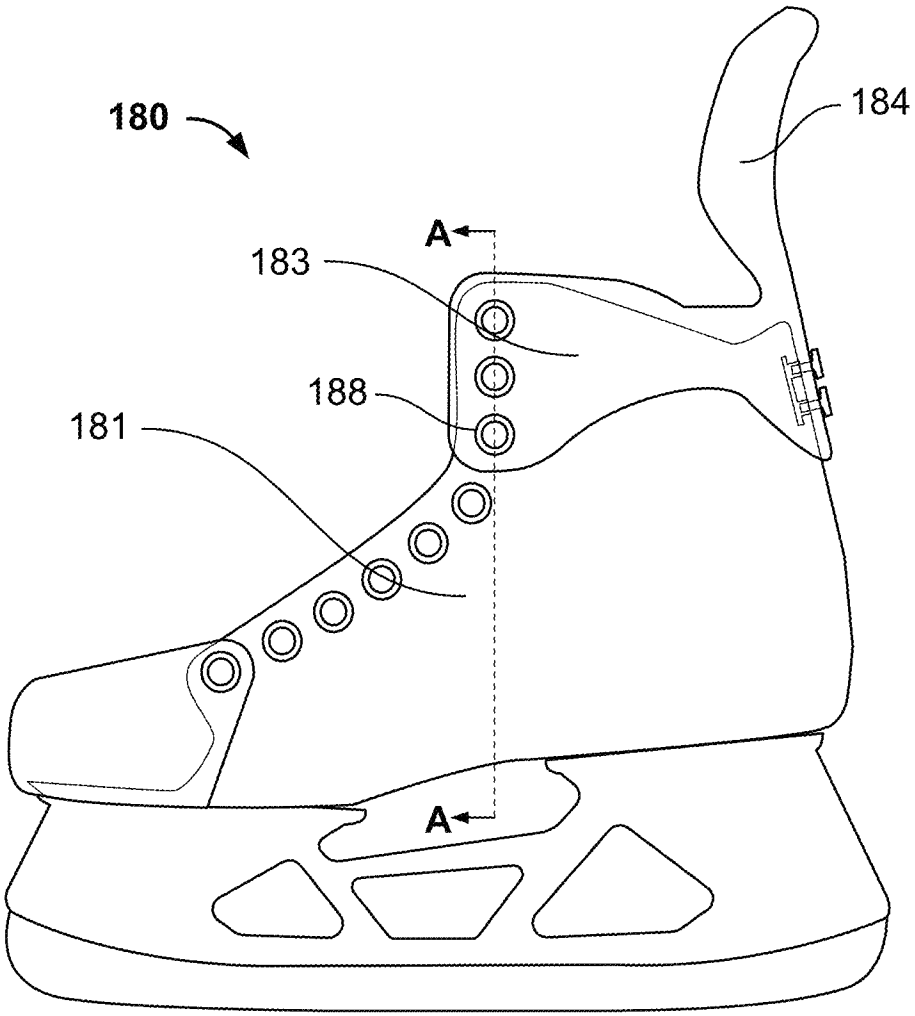
FIG. 18A shows a lateral side elevation view of an article of footwear having a cuff/tendon guard, in accordance with some embodiments of the present invention.

Referring to FIGS. 18A-18B, another embodiment of a modified article of footwear 180 includes the boot or shell portion 181 that includes features of the boot or shell portion 11 of FIGS. 1A and 1B modified by addition of one or more pairs of elongated eyelets 188. In some applications, the modified article of footwear 180 further includes a cuff/tendon guard ("tendon guard cuff") including a main (e.g., cuff) portion 183 and an Achilles heel tendon portion 184. The elongated eyelets 188 may be provided along a periphery of the boot or shell portion 181 and tendon guard cuff. As an example, the elongated eyelets 188 may be provided along edges of medial and lateral forefoot and/or ankle portions of the boot or shell portion 181 and the tendon guard cuff. In some variations, the elongated eyelets 188 may be defined by the periphery, e.g., edges, of the medial and lateral ankle portions of the boot or shell portion 181 and a cuff portion 183 of the tendon guard cuff. In the example illustrated in FIG. 18B, the elongated eyelets 188 may extend between and form eyelets of each of the tendon guard cuff and the boot or shell portion 181. In some variations, the elongated eyelets 188 can mechanically couple the cuff portion 183 of the tendon guard cuff to the boot or shell portion 181, with the elongated eyelets 188 being shared by the cuff portion 183 and the boot or shell portion 181. For each of the elongated eyelets 188, such elongated eyelet 188 can receive a portion of a lacing, with the lacing extending through each of the adjacently positioned cuff portion 183 and boot or shell portion 181. In some variations, one or more of the pairs of eyelets of the modified article of footwear 180 can be or include pairs of elongated eyelets 188 fixedly coupling the tendon guard cuff and boot or shell portion 181. In some variations, the elongated eyelets 188 may be positioned closest to the user's instep, i.e., at the opening for inserting the skater's foot. Any number of the eyelets of the modified article of footwear may be elongated eyelets that extend between, form eyelets of, and couple each of the tendon guard cuff and the boot or shell portion 181. As an example, between zero and five pairs of eyelets, e.g., three pairs of eyelets, of the modified article of footwear 180 may be elongated eyelets 188. In the example illustrated in FIGS. 18A and 18B, the three pairs of eyelets of the modified article of footwear 180 proximate the user's instep, i.e., at the opening for inserting the skater's foot, may be elongated eyelets 188. In some variations, one or more individual eyelets of the of the modified article of footwear may be elongated eyelets 188.

Manufacturing Techniques for Components of an Ice Hockey Skate

A boot or shell portion or a mating component for a boot or shell portion such as a tendon guard, a toe cap, an ankle cuff, a cuff/tendon guard, and so forth herein may be manufactured by various techniques, including techniques described in U.S. patent application Ser. No. 18/586,090. In particular, in some embodiments, a boot or shell portion of an article of footwear (e.g., hockey skate) can be manufactured by assembling multiple layers of (e.g., relatively flat) two-dimensional fabrics, attaching the fabric layers to one another, and forming the boot or shell portion. Exemplary fibers for use in these fabrics may include: glass fibers, carbon fibers, fiberglass, natural fibers, plastic fibers, metallic fibers, and combinations thereof. By convention, before assembly, each fabric layer may be cut from larger fabric or material pieces or sheets. These sheets may include woven fibers alone (dry) or woven fibers embedded in a resin matrix. The cutting operation may be performed by hand or may involve using dies or a computer numerical control (CNC) process. Complex shapes allow the engineer to tailor performance and achieve a lighter weight boot.

When assembled and attached to one another, the fibers of the fabric layers may be oriented symmetrically relative to one another. For example, a typical weaving loom produces fabric with fibers in the warp (longitudinal) and weft (crossing) directions. The warp fibers typically run perpendicular to the weft fibers. Therefore, a typical fabric increases stiffness in a first axis and a second axis running perpendicular to the first. The weaver may choose to apply more fiber in the weft direction and less fiber in the warp direction (or vice-versa) to tailor stiffness properties. An engineer may also consider one-dimensional fabrics.

During the weaving process, the individual fibers may move back and forth and slide on top of each other. As such, it may be preferred for the surface of the fibers to be smooth and free of tack. Indeed, this is the case with raw fibers and typical co-mingled fibers produced with thermoplastics. When weaving thermoset tow-preg tapes, steps must be taken to reduce or, preferably, remove the tack from the tapes. This may be done, for example, by adjusting the chemistry of the epoxy or substantially reducing the temperature in the weaving area.

Attaching the various fabric layers may involve, for example, one or more of: gluing, laminating, consolidating, and the like. Various compression or wet lay-up processes may be used to form the boot or shell portion. In some variations, the desired, finished shape or product multiple layers may be a boot or shell portion or a mating component for a boot or shell portion such as a tendon guard, a toe cap, an ankle cuff, a cuff/tendon guard, and so forth.

In some embodiments, a boot or shell portion can be manufactured by tailored fiber placement (TFP), which is an embroidery-based, tow-steering process that enables complete control over fiber placement and directionality. Succinctly, TFP enables embroidering and tacking a single, continuous fiber (or "tow") or, alternatively, tacking any number of fibers of the same or different composition, onto a substrate in a process known as roving. For the purpose of illustration rather than limitation, the term "fibers" used in this description includes non-orthotropic structural material that may be raw fibers as well as co-mingled fibers. Raw fibers may be defined as a single tow comprised of one or more materials, which can include glass fibers, carbon fiber, fiberglass, glass fiber, copper filament, metal filament (e.g., steel filament and the like), aromatic polyamid (aramid), polydioxanone (PDO), polyester, polypropylene (PP), and the like. Typically, when raw fibers are used, a resin (e.g., epoxy) matrix is introduced (e.g., via vacuum-assisted resin transfer molding (VARTM), infusion, wet lay-up, film lamination, and so forth) to create a composite structure. Co-mingled fibers are composed or two or more fibers made from different materials, one of which is often a thermoplastic fiber (e.g., nylon, polyester, aramid, polyamide 6 (PA6), polyamide 12 (PA12), PEAK, poly(p-phenylene-2, 6-benzobisoxazole) (PBO), polymethyl methacrylate (PMMA), PP, and the like) or thermoset fiber (e.g., epoxy) that, upon heating, produces a resin matrix. Representative examples of co-mingled fibers (e.g., co-mingled thermoplastic fibers) include: carbon fiber/PA6, carbon fiber/PEAK, fiberglass/PA6, aramid/PA12, and so forth. Typically, co-mingled fibers may be heated to melt the thermoplastic material until flowing, which becomes a resin matrix that envelopes the remaining (e.g., solid) material(s) of the co-mingled fibers. An advantage to the use of co-mingled fibers is integration of the resin matrix directly into the fibers. By integrating the resin matrix directly into the co-mingled fibers, it is no longer necessary to introduce the resin matrix in a secondary step (e.g., VARTM, infusion, wet lay-up, film lamination, and so forth). A second advantage to the use of co-mingled fibers is the even distribution of the resin matrix relative to the fibers in a preform including the fibers. For example, when the co-mingled fibers are heated to melt the thermoplastic material until flowing, the thermoplastic material can evenly distribute across the remaining material(s) of the co-mingled fibers. Such use of co-mingled fibers reduces the likelihood of generating a finished shape or product with an uneven fiber volume fraction across the structure.

In some embodiments of the present disclosure, TFP may be used, such that a pattern or preform of a part resembling a desired, finished shape or product (e.g., a skate boot shell, a mating component therefor, and the like) may be embroidered onto a substrate. The desired, finished shape or product described herein may be a boot or shell portion, an outsole for a skate boot, and/or a composite boot or shell portion and outsole. Each of the boot or shell portion, the outsole, and/or the composite boot or shell portion and outsole may be formed from one or more two-dimensional preforms that are formed into three-dimensional preforms and placed into and/or onto a mold. In some variations, the desired, finished shape or product of the preforms may be a boot or shell portion or a mating component for a boot or shell portion such as a tendon guard, a toe cap, an ankle cuff, a cuff/tendon guard, and so forth.

Embodiments of an article of footwear (e.g., hockey skate) may include one or more features and/or characteristics of any of the articles of footwear described herein. As an example, embodiments of an article of footwear may include one or more features and/or characteristics of any of the boot or shell portions and/or cuff/tendon guards described herein. The terms and expressions employed herein are used as terms and expressions of description and not of limitation and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. The structural features and functions of the various embodiments may be arranged in various combinations and permutations, and all are considered to be within the scope of the disclosed embodiments of the invention. Unless otherwise necessitated, recited steps in the various methods may be performed in any order and certain steps may be performed substantially simultaneously. Accordingly, the described embodiments are to be considered in all respects as only illustrative and not restrictive. Furthermore, the configurations described herein are intended as illustrative and in no way limiting. Similarly, although physical explanations have been provided for explanatory purposes, there is no intent to be bound by any particular theory or mechanism, or to limit the claims in accordance therewith.

What we claim is:

1. An article of footwear for use in ice skating, the article of footwear comprising:

a boot shell structured and arranged to accommodate a wearer's foot and having a medial forefoot portion, a lateral forefoot portion, a medial quarter/midfoot portion, a lateral quarter/midfoot portion, a sole portion, a lateral ankle portion, a medial ankle portion, and a heel portion, the boot shell further comprising:

at least one flexible rail portion attached to the heel portion of the boot shell;

a cuff/tendon guard comprising a cuff mounting portion attached to the flexible rail portion; and non-orthotropic fibers, wherein the non-orthotropic fibers are at least one of asymmetric and unbalanced.

2. The article of footwear of claim 1, wherein the flexible rail portion comprises a flange cantilevered from the heel portion of the boot shell.

3. The article of footwear of claim 1, wherein the flexible rail portion extends to at least one of: to, below, or above a height of the lateral and medial ankle portions of the boot shell.

4. The article of footwear of claim 1, wherein the flexible rail portion is separated from the lateral and medial ankle portions of the boot shell by a pair of gaps.

5. The article of footwear of claim 1, wherein the flexible rail portion is structured and arranged to be elastically deformable along a longitudinal axis of the article of footwear.

6. The article of footwear of claim 1, wherein the flexible rail portion is structured and arranged to:

provide progressive flexure and energy storage during a loading phase of a skating stride, wherein the loading phase of the skating stride comprises dorsiflexion of the wearer's foot to a dorsiflexed position; and provide an energy return based on the energy storage during an unloading phase of the skating stride, wherein the unloading phase of the skating stride comprises recovery of the wearer's foot to a neutral position from the dorsiflexed position.

7. The article of footwear of claim 1, wherein the flexible rail portion is at least one of fixedly attached to the heel portion of the boot shell or removably attached to the heel portion of the boot shell.

8. The article of footwear of claim 1, wherein the flexible rail portion is integrated into the heel portion of the boot shell.

9. The article of footwear of claim 1, wherein the cuff/tendon guard comprises a thermoplastic composite material.

10. The article of footwear of claim 1, wherein the cuff/tendon guard is at least one of fixedly attached to the flexible rail portion or removably attached to the flexible rail portion.

11. The article of footwear of claim 1, wherein the cuff/tendon guard is posteriorly biased in a neutral state.

12. The article of footwear of claim 1, wherein the cuff/tendon guard is configured to follow contouring of the boot shell.

13. An article of footwear for use in ice skating, the article of footwear comprising:

a boot shell structured and arranged to accommodate a wearer's foot and having a medial forefoot portion, a lateral forefoot portion, a medial quarter/midfoot portion, a lateral quarter/midfoot portion, a sole portion, a lateral ankle portion, a medial ankle portion, and a heel portion, the boot shell further comprising:

at least one flexible rail portion attached to the heel portion of the boot shell; and a cuff/tendon guard comprising (i) a cuff mounting portion attached to the flexible rail portion, and (ii) a sleeve portion that is configured to accommodate the flexible rail portion.

14. An article of footwear for use in ice skating, the article of footwear comprising:

a boot shell structured and arranged to accommodate a wearer's foot and having a medial forefoot portion, a lateral forefoot portion, a medial quarter/midfoot portion, a lateral quarter/midfoot portion, a sole portion, a lateral ankle portion, a medial ankle portion, and a heel portion, the boot shell further comprising non-orthotropic fibers, wherein the non-orthotropic fibers are at least one of asymmetric and unbalanced; and a cuff/tendon guard attached to the boot shell.

15. The article of footwear of claim 14, wherein the cuff/tendon guard comprises (i) a cuff portion manufactured from an elastomer material and (ii) a tendon guard portion manufactured from a thermoplastic composite material.

16. The article of footwear of claim 14, wherein the cuff/tendon guard comprises a tensile structure manufactured from an elastomer material.

17. The article of footwear of claim 16, wherein the tensile structure is structured and arranged to be elastically deformable along a longitudinal axis of the article of footwear.

18. The article of footwear of claim 14, further comprising a plurality of eyelets defined by (i) the lateral and medial ankle portions of the boot shell and (ii) the cuff/tendon guard, wherein the cuff/tendon guard is attached to the boot shell by one or more of the plurality of eyelets.

* * * * *